US006343894B1

(12) United States Patent
Fearn

(10) Patent No.: US 6,343,894 B1
(45) Date of Patent: Feb. 5, 2002

(54) REUSABLE BUILDING FOUNDATION FORM APPARATUS AND METHOD

(76) Inventor: Richard Neil Fearn, 2618 Crescent Drive, South Surrey, British Columbia (CA), V4A 3K2

( * ) Notice: Subject to any disclaimer, the term of this patent is extended or adjusted under 35 U.S.C. 154(b) by 0 days.

(21) Appl. No.: 09/472,770

(22) Filed: Dec. 27, 1999

Related U.S. Application Data

(63) Continuation of application No. PCT/CA98/00619, filed on Jun. 25, 1998.

(60) Provisional application No. 60/051,129, filed on Jun. 27, 1997.

(51) Int. Cl.[7] ..... E02D 5/14; E02D 5/34

(52) U.S. Cl. ..... 405/233; 405/252; 405/257; 249/13; 249/112; 249/168

(58) Field of Search ..... 405/229, 231, 405/233, 251, 252, 256, 257; 249/13, 112, 154, 160, 163, 168

(56) References Cited

U.S. PATENT DOCUMENTS 4,983,077 A 1/1991 Sorge et al.
5,224,321 A 7/1993 Fearn
5,495,696 A * 3/1996 Repka
6,238,144 B1 * 5/2001 Babcock

OTHER PUBLICATIONS

International Search Report for Application PCT/CA98/00619, dated Oct. 7, 1998.

* cited by examiner

*Primary Examiner*—Roger Schoeppel
(74) *Attorney, Agent, or Firm*—Kolisch Hartwell, Dickinson McCormack & Heuser

(57) ABSTRACT

A building foundation form apparatus and method uses transverse form supports (15) supported directly on the ground and carrying longitudinal form supports (21, 22) adjustably located on opposite sides of, and substantially parallel to, a foundation axis (17). A flexible sheet form element (25) has edge portions (57, 58) connected to the longitudinal form supports (21, 22) and a contact portion (60) located between the edge portions and supported on the ground and deformed into a general U-shape with overhanging bulges (39) to receive the flowable and settable foundation mixture. The longitudinal form supports (21, 22) are adjustable vertically to accommodate ground undulations to ensure correct footing width. The contact portion (60) has mesh opening to pass the foundation mixture therethrough to enhance adhesion to the ground. Also, the sheet form element has marginal portions (47,48) extending upwardly from the contact portion to the bulges (39), the marginal portions (47, 48) having mesh openings which pass concrete mixture to fill voids beneath the overhanging bulges (39).

39 Claims, 11 Drawing Sheets

REUSABLE BUILDING FOUNDATION FORM APPARATUS AND METHOD

CROSS-REFERENCE TO RELATED APPLICATIONS

This application is based on and claims priority to United States Provisional Application No. 60/051,129, filed Jun. 27, 1997, and a continuation PCT Application No. PCT/CA/98/00619, filed Jun. 25, 1998.

BACKGROUND OF THE INVENTION

The invention relates to an apparatus and method for producing building foundations from poured concrete, particularly an essentially reusable concrete foundation form apparatus and method of use.

Poured concrete foundations for buildings have been used for many years and usually require disposable formwork such as lengths of lumber and plywood sheets, which are temporarily installed on the ground or site surfaces. Installing conventional foundation forms is a time-consuming, labour-intensive task and is often conducted in poor conditions of loose topsoil and/or rocks etc. These conditions are often aggravated by rain or ground water which further destabilizes the soil and commonly requires pumping prior to pouring the concrete. Preferably, such foundations are installed on relatively level ground or site surfaces, and the above difficulties are compounded when the site is not level, i.e. it slopes in one or more directions. Installation costs increase because a sloping site usually requires additional excavation to level the site prior to installing foundation forms.

When a single storey building is to be built on a level site, sometimes relatively simple foundations can be installed. Simple foundations usually require a footing with or without a relatively low wall extending thereabove to receive longitudinal horizontal timbers upon which the building can be erected. On the other hand, a foundation for a building with a basement usually requires a footing with a relatively high basement wall extending upwardly therefrom, the basement wall having a width typically between one half and one quarter of the width of the footing, depending on building code requirements. A footing combined with a high wall is commonly made in two stages, the first stage being the preparation of the footing form and footing by itself. After the first pour of concrete has set to produce the footing, wall forms are erected above the footing to receive the second pour of concrete to form the wall itself. This two-stage type of foundation is relatively time consuming because it requires relatively close control of the locations of two sets of the form members to ensure compliance with building code requirements.

Both types of foundation formwork described above use lengths of lumber and plywood sheets which, after stripping from the set concrete, are contaminated with concrete and thus are usually unsuitable for use elsewhere in the building, except perhaps in low-grade or temporary construction work. Consequently, when constructing conventional concrete foundation forms, there is usually a high labour input both in installing the forms and stripping the forms after pouring the concrete, and there is also high wastage of form material when the poured foundation has been stripped.

U.S. Pat. No. 5,224,321 discloses an earlier invention of the present applicant in which a foundation form assembly is secured to a temporarily supported prefabricated floor assembly. The foundation form assembly extends downwardly from the floor assembly towards a building site surface which supports jacks which in turn temporarily support the floor assembly. The form assembly comprises inner and outer rigid sheet panels which serve as upper forms and are connected to the floor assembly. Lower portions of the rigid sheet panels are connected to upper edges of a flexible fabric sheet lower form element which rests on the site surface and extends as a generally U-shaped elongated container between the inner and outer sheet forms. The flexible fabric sheet form conforms to undulations of the site surface when it receives a flowable concrete mixture, and thus accommodates variations in height between the form and the site surface, thus reducing work required to prepare the site surface. Form ties extend between the inner and outer rigid forms to restrict movement thereof and to resist forces from the concrete before it sets. The poured concrete has an upper surface in contact with the floor assembly to provide permanent support therefor. When the concrete sets, the jacks are removed and the outer rigid sheet forms can be removed or can remain in place. This patent discloses a flexible sheet form element which provides a footing to accommodate site undulations and slope, and while it has many advantages over prior art foundation structures, the time for installing and levelling the prefabricated floor assembly and attaching the rigid sheet forms thereto increases the cost of both materials and labour when compared with the present invention.

German Patent Publication 2062998, in which the applicant is Beton-U. Monierbau AG, discloses several embodiments of poured concrete foundations in which a flexible fabric sheet form is located adjacent or beneath a temporarily supported component, and thus resembles to some extent the device of the above patent. In one embodiment, upper edges of the fabric sheet form are connected to the component to provide an elongated container below the component to receive flowable concrete, which when set supports the component. The sheet form assumes a shape determined to some extent by optional stiffeners positioned within the form, but not connected thereto, or other constraints located externally of the sheet form. This invention is particularly applicable for providing foundations for structure to be supported above a body of water.

Both of the references discussed above use a flexible fabric sheet form element which permits the footing to conform to the site surface, but require restraining structure to maintain the sheet form element in place and to attempt to control shape of the flexible sheet form element to reduce the volume of concrete required. In both references, when unrestrained lowermost portions of the flexible sheet form hold fluid concrete, a contact portion of the fabric sheet form is forced into contact with the ground and, when the concrete is solidified carries weight of the building. Hoop stresses are generated in the fabric sheet form and the sheet develops curved bulging marginal portions which extend upwardly and outwardly from the contact portion to upper portions of the fabric sheet which are supported. Thus voids are formed between the marginal portions and the site surface and therefore the contact portion always has a width which is less than maximum or overall width of the footing due to the outwardly bulging marginal portions. Because building load is transferred to the ground only through the contact portion, and not through the bulging marginal portions, concrete in the marginal portions is not used efficiently to transfer load to the ground and thus represents a waste of concrete. Hoop stresses in the fabric increase and width of the contact portion decreases as the concrete mixture is made more fluid, and thus wastage of concrete can become excessive. In addition, the fabric of the sheet form element does not permit concrete to pass therethrough, and thus relatively small voids can be formed between the contact portion of the sheet and the ground immediately beneath the contact portion, thus reducing shear strength between the foundation itself and the ground. If the sheet has a low friction surface, shear strength is reduced still further, which can cause problems during seismic activity.

SUMMARY OF THE INVENTION

The invention reduces the difficulties and disadvantages of the prior art by providing a building foundation form apparatus which can be quickly installed on a building site for considerably less cost than conventional foundation forms. In addition, volume of concrete used can be much less than that used with conventional rigid forms and the flexible fabric sheet forms disclosed in said prior art references. Installation costs are reduced because the invention provides a plurality of pre-fabricated form supports which can be assembled quickly and easily, accurately aligned, and readied for concrete pouring in a fraction of the time required for conventional foundation forms.

The invention uses a flexible sheet form element which is supported by the form supports and is used to contain and partially shape the concrete, and prevent contamination of the form supports with the concrete. Lower portions of the flexible sheet form element can deform to accommodate undulations in the building site surface and sloping sites to a far greater degree than those that can be accommodated using conventional rigid sheet concrete foundation forms and thus requires minimal excavation. When the concrete is set, the form supports can be removed quickly, leaving the flexible sheet form element in place as it is of relatively low cost. The form supports, being free from contamination of concrete, are available for reuse. Thus the concrete form apparatus is mostly reusable and this essentially eliminates waste of most of the form material at the building site. In addition, selected portions of the flexible sheet form element are provided with controlled discharge portions with openings which permit passage of concrete therethrough onto the building site surface. This forms a connection between the site surface and the foundation material within the flexible sheet form element, increasing shear resistance between the foundation and the site surface. In addition, concrete discharged from bulges of the marginal portions essentially fills the voids between the bulges and the site surfaces, thus increasing effective footing width and improving utilization of the concrete.

A building foundation form apparatus according to the invention comprises at least first and second transverse form supports, at least first and second longitudinal form supports, and a flexible sheet form element. The first and second transverse form support are adapted to be supported directly on the ground and are longitudinally spaced apart along a longitudinal foundation axis. The first and second longitudinal form supports are adapted to be located on opposite sides of, and substantially parallel to, the foundation axis. Each longitudinal form support is connectable to said at least two transverse form supports so that each longitudinal form support is locatable at a position above the ground. The flexible sheet form element has first and second longitudinally extending edge portions and a contact portion located between the edge portions. Transverse spacing between the edge portions defines width of the sheet form element when flattened. The first and second edge portions are securable to the first and second longitudinal form supports respectively. In this way, the sheet form element is supportable partially by the longitudinal form supports and can lie substantially along the foundation axis. The width of the sheet form element is such that most of the contact portion thereof is at least partially supportable on the ground when the flexible sheet form element is deformed into a generally U-shape and receives a flowable and settable foundation mixture.

A building foundation according to the invention comprises a foundation form apparatus and a set foundation mixture contained therein, the form apparatus comprising at least first and second transverse form supports, at least first and second longitudinal form supports and a flexible sheet form element. The first and second transverse form supports are supported directly on the ground and are longitudinally spaced apart along a longitudinal foundation axis. The first and second longitudinal form supports are located on opposite sides of, and substantially parallel to, the foundation axis. Each longitudinal form support is connected to said at least two transverse form supports so that each longitudinal form support is located at a position above the ground. The flexible sheet form element has first and second longitudinally extending edge portions and a contact portion located beneath the edge portions. The first and second edge portions are secured to the first and second longitudinal form supports respectively so that the sheet form element is deformed into a general U-shape to contain the foundation mixture. The sheet form element is at least partially supported by the longitudinal form supports and lie substantially along the foundation axis. The sheet form element has a width such that most of the contact portion is at least partially supported on the ground.

A transverse form support according to the invention is for use in the foundation form apparatus and comprises first and second legs and a leg tie. The first and second legs have upper and lower leg portions, each lower leg portion has a base portion to resist ground penetration, and each upper portion has a form connector. The leg tie extends between the upper portions of the legs to connect the legs together, and is adjustable substantially vertically along the legs. The leg tie is disposed generally perpendicularly and rigidly to the upper portions of each leg.

A flexible sheet form element is for use in a foundation form apparatus to receive a flowable and settable concrete mixture, the flexible sheet form element comprising a flexible sheet and means to control fullness of the flexible sheet. The flexible sheet has first and second parallel longitudinally extending edges and an adjacent respective edge portion, and a contact portion located between the edge portions. The means to control fullness of the flexible sheet is to maintain adequate footing widths when the sheet is supported along the edge portions thereof to receive the foundation mixture. The means to control fullness of the sheet comprises a longitudinally extending center line disposed symmetrically of the edges of the flexible sheet and symmetrically of the contact portion, and first and second sets of longitudinal guidelines located in the first and second edge portions respectively, each set having a plurality of laterally spaced apart guidelines disposed parallel to the centre line. Each guideline of the first set is identifiable with an equivalent guideline of the second set to form a pair of equivalent guidelines which are spaced equally from the centre line.

Another embodiment of a flexible sheet form element is for use as a foundation form to receive a flowable and settable foundation mixture and comprises a flexible sheet having at least one controlled discharge portion which can pass therethrough at least a portion of the foundation mixture.

A method of installing a building foundation according to the invention, comprises the following steps: supporting at least first and second transverse form supports directly on the ground and spaced apart along a longitudinal foundation axis; locating at least first and second longitudinal form supports on opposite sides of the foundation axis, and connecting each longitudinal form support to said at least two transverse form supports so that at least one longitudinal form support is positioned above the ground on each side of the foundation axis and extends between the transverse form supports; connecting first and second longitudinally extending edge portions of a flexible sheet form element to the first and second longitudinal form supports so that the sheet form element is deformed into a general U-shape and extends longitudinally between the first and second transverse form supports, and laterally between the first and second longitudinal form supports and is at least supported partially by the longitudinal form elements; and pouring a settable, flowable foundation mixture into the at least partially supported flexible sheet form element so that most of a contact portion of the flexible sheet form element is at least partially supported on the ground when the flexible sheet form element deforms into the general U-shape due to weight of the settable, flowable foundation mixture.

Another method of installing a building foundation comprises the following steps: supporting portions of a flexible sheet form element above the ground, the sheet form element being deformed to produce a foundation form and having a contact portion to contact the ground; pouring a flowable and settable foundation mixture into the flexible sheet form element to be mostly contained within the foundation form; permitting controlled discharge of a portion of the foundation mixture from inside the form element through a controlled discharge portion thereof onto the ground to produce a connection therewith.

A detailed disclosure following, related to drawings, describes apparatus and method of several embodiments of the invention, which apparatus and method are capable of expression in structure and method other than those particularly described and illustrated.

DETAILED DESCRIPTION

FIG. 1

Figure 1:
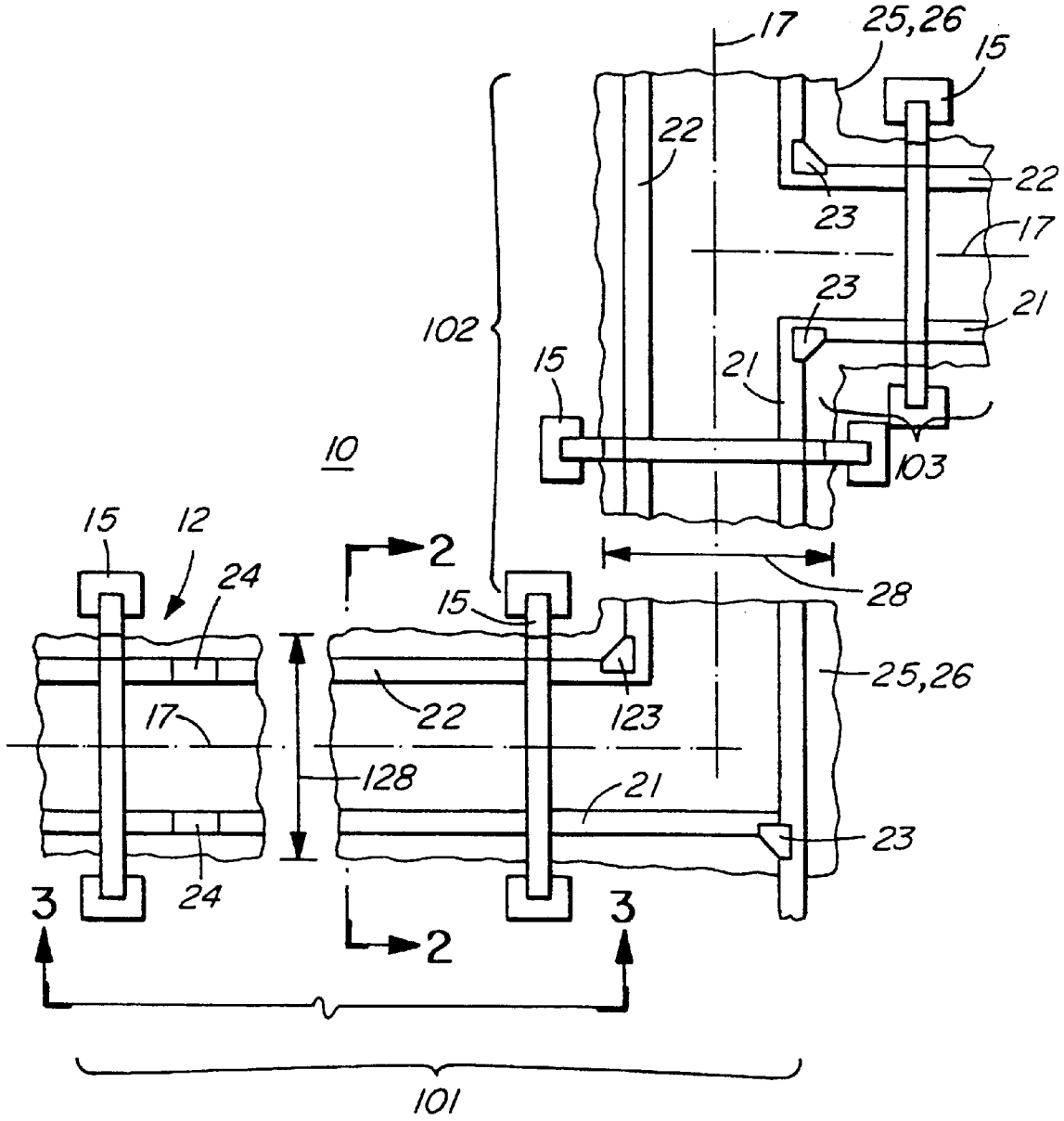
FIG. 1 is a simplified fragmented top plan of a portion of a building foundation form apparatus according to the invention.

A building site surface or ground 10 is shown supporting a building foundation form apparatus 12 according to a first embodiment of the invention. The apparatus includes a plurality of transverse form supports 15 which are supported directly on the site surface 10 and longitudinally spaced apart along a longitudinal foundation axis 17. The apparatus 12 further includes first and second longitudinal form supports 21 and 22 which are located on opposite sides of, and substantially parallel to, the foundation axis 17. The first and second longitudinal form supports are located on outer and inner sides of the longitudinal foundation axis 17, and usually comprise a plurality of standard dimensioned lengths of sawn lumber which are located along opposite sides of the apparatus with adjacent ends temporarily interconnected with brackets 23 or 24 as shown. The brackets 23 connect non-aligned intersecting lengths of lumber together at corners of the foundation, whereas the brackets 24 connect aligned lengths of lumber together when the length of a particular wall is greater than the length of the lumber.

The apparatus 12 further comprises a flexible sheet form element 25 which is located to be at least partially supported on the ground and extends along the axis 17 and beneath the transverse form supports 15 and the longitudinal form supports 21 and 22. As will be described with respect to FIGS. 2–5, the flexible sheet form element 25 is supported by the longitudinal form supports 21 and 22 along its length, and has a sheet width which is sufficient to provide a footing 26 of adequate footing width 28 as will be described.

FIGS. 2–5

Figure 2:
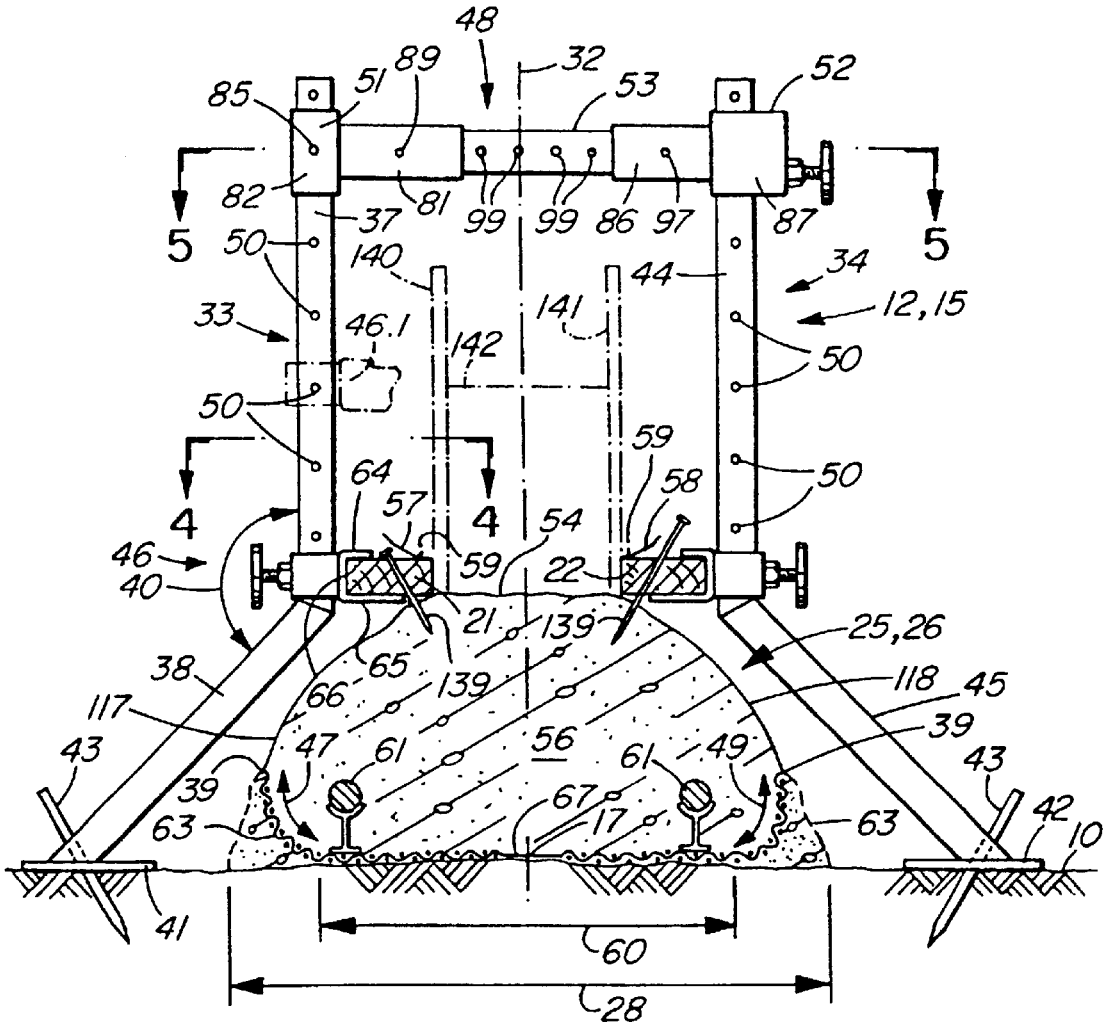
FIG. 2 is a simplified fragmented section on line 2—2 of FIG. 1 showing a first embodiment of a transverse form support and a longitudinal form support to produce a footing only.

Referring to FIG. 2, the transverse form support 15 is generally symmetrical about a vertical plane of symmetry 32 which contains the longitudinal axis 17 of the foundation. The transverse form support 15 comprises similar first and second legs 33 and 34 which are located adjacent outer sides of and support the first and second longitudinal form supports 21 and 22 as shown. The legs are disposed as mirror images of each other about the plane 32 and thus the first leg 33 only will be described in detail. The leg 33 has straight upper and lower leg portions 37 and 38 respectively, the lower leg portion 38 being inclined at an angle 40 to the respective upper leg portion 37 so as to extend downwardly from the upper leg portion and also outwardly away from the remaining leg 34. The angle 40 is about 45 degrees but can range between 30 and 60 degrees, depending on the specific application. The upper and lower leg portions 37 and 38 are made from square-sectioned tube (see FIG. 4) and can be welded together at the angle 40 to provide a sturdy connection. The lower leg portion has a base portion 41 which is a rectangular flat plate and is inclined generally horizontally so as to rest against the site surface 10 to resist ground penetration due to weight of the form and poured concrete. For additional security, a ground penetrating spike 43 passes through an opening in the base portion 42, and when driven into the ground assists in resisting lateral movement of the leg with respect to the site surface. The second leg 34 has similar upper and lower leg portions 44 and 45, a base portion 42 and spike. As the site surface 10 is relatively level in a lateral transverse direction, the base plates 41 and 42 are also generally level with each other, although this is not necessary as will be described.

Figure 3:
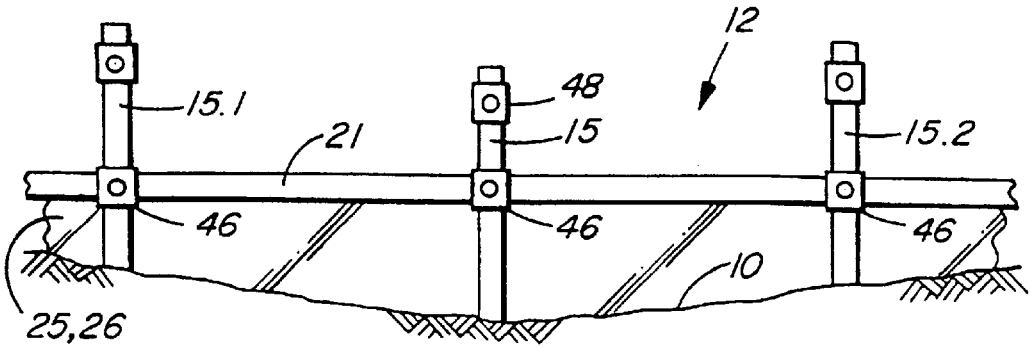
FIG. 3 is a simplified fragmented side elevation as seen from line 3—3 of FIG. 1 showing the three first embodiments of the transverse form support supporting the first embodiment of the longitudinal form supports.

The upper leg portion 37 carries a form connector 46 which releasably connects the first longitudinal form support 21 to the transverse form support 15 as will be described with respect to FIG. 4. As best seen in FIG. 3, the site surface 10 can have random longitudinal undulations along the axis 17 of the foundation, and in general, the transverse form supports are located at generally regular intervals along the longitudinal form supports 21 and 22 irrespective of the undulations of the site. For convenience, three adjacent transverse form supports are designated 15.1, 15 and 15.2, and it can be seen that the middle transverse form support 15 is located at a position lower than the adjacent form supports 15.1 and 15.2. Each of the form connectors 46 are adjustable vertically, i.e. axially along the respective upper leg portions of the transverse form supports. Thus the form support 21 can be maintained generally horizontal, and site undulations are accommodated by adjusting location of the form connector on the respective leg. An alternative upper position of one form connector is shown at 46.1 in FIG. 2, which corresponds approximately to the location of the form connector for the middle transverse form support 15 shown at a lowest position of the site in FIG. 3.

Referring again to FIG. 2, the transverse form support further comprises a leg tie 48 extending between the upper leg portions 37 and 44 to connect the legs 33 and 34 together as will be described with respect to FIG. 5. For manufacturing simplicity, both the upper leg portions have a plurality of transverse openings 50 passing therethrough, the openings being spaced apart at equal intervals of about 1–2 inches (2.5–5.0 cm). The leg tie 48 has first, second and third tie portions 51, 52 and 53, the first and second tie portions being releasably connected to the upper leg portions 37 and 44 of the first and second legs so as to locate one end of the leg tie on each leg. While specific vertical location of the leg tie 48 is not critical, in general it is located usually closely adjacent upper ends of the upper leg portions to provide clearance for installing the longitudinal forms as needed below the leg connector as will be described. Further details of the leg tie 48 will be described with reference to FIG. 5.

The flexible sheet form element 25 is shown deformed into a general U-shape and containing poured concrete 56 to produce the footing 26 with a flat and level upper surface 54. The sheet element 25 has first and second longitudinally extending edge portions 57 and 58 connected to the first and second longitudinal form supports 21 and 22 respectively by staples 59. The sheet form element 25 is sufficiently flexible to distort under the hydraulic forces of the poured fluid concrete before it sets to assume the curved shape as shown, and in general the element 25 is not deliberately restrained by contact with the lower leg portions, although limited contact with the lower leg portions is not a problem. A lowermost portion of the sheet form element 25 is in contact with and supported directly by the site surface 10, and is defined as a contact portion 60 and is usually disposed generally symmetrically of the vertical plane of symmetry 32 as shown. When the form element 25 contains fluid concrete, fluid pressures act on the fabric to hold the contact portion 60 on the ground, and to distort the fabric adjacent the contact portion into overhanging bulges 39 which extend upwardly and outwardly from both sides of the contact portion. Portions of fabric extending below the bulges 39 to the contact portion 60 are defined as first and second marginal portions 47 and 49 and are located adjacent the first and second legs 33 and 34 respectively. Geometrical profile of the bulges varies depending on fluidity of the concrete mix, and in general, the more fluid the concrete mix, the narrower the contact portion becomes. Stresses in the fabric are termed "hoop stresses" and increase as fluidity and height of the concrete increases. Overall perimeter of the sheet form element as shown sectioned in FIG. 2 is dependent on width of the sheet form element and is determined, to some extent, by trial and error. The perimeter is mainly dependent on horizontal spacing between the edge portions 57 and 58, that is width of the surface 54 between opposed inner faces of the first and second longitudinal form supports 21 and 22, and height of the form supports 21 and 22 above the site surface 10.

The flexible sheet form element 25 is preferably a woven geotextile fabric which is abrasion resistant and has sufficient strength to withstand hydrostatic pressures generated by pouring concrete into a form which is supported along upper edges, and along the contact portion respectively. Thus, the geotextile fabric should be woven of relatively tough material which can withstand not only the hoop stresses but also high localised point stresses from loading from the concrete being transferred to the staples 59 secured to the longitudinal form supports. A satisfactory type of geotextile fabric is made from woven synthetic fibre, typically polyethylene, and is marketed under the trade-mark FABRENE LE by Fabrene Corporation of Charlotte, N.C., U.S.A. Preferably, the flexible form element 25 also has selected portions above the bulges 39 which are sufficiently water permeable to enhance de-watering of the concrete for faster consolidation of the concrete.

The contact portion 60 has a mesh portion which can resemble a relatively coarse net having a mesh opening size which is sufficiently large to pass easily therethrough maximum sized aggregate used in the concrete mixture. A central portion 67 of the contact portion 60 is located within the plane 32 and preferably is not a mesh portion for reasons to be described. Concrete mixture passing through the openings of the mesh portions fills any void between the contact portion and the site surface 10 and improves shear resistance between the finished foundation and the site surface, thus improving seismic performance of the foundation. Weight of concrete resting on the contact portion itself is sufficient to prevent hoop stresses that act on the contact portion from tending to lift the contact portion from the site surface which otherwise might occur with insufficient loading. Any tendency to lift the contact portion from the site surface would be increased by excessive vibration, excessive fluidity of concrete, or a low ratio of coarse aggregate, and thus these factors should be considered.

As previously described, in the prior art structures utilizing flexible fabric forms, the bulges generated in the fabric forms by the fluid concrete mixture produce voids which reduce effective foundation width, which results in inefficient use of concrete. To reduce this inefficiency, in the present invention the marginal portions 47 and 48 are also mesh portions, which preferably have a mesh opening size at least twice greater than the maximum sized aggregate used in the concrete mixture, so as to pass maximum sized aggregate easily therethrough and thus avoid possible blocking of the mesh openings by the maximum sized aggregate. Flow of concrete through the mesh openings of the marginal portions produces oppositely located portions of slumped concrete 63 which flow through the mesh portions onto the site surface 10 and stabilize at a typical stable slump angle of between about 45 degrees and 60 degrees as shown. The slumped concrete essentially fills the voids that would otherwise exist between each bulge 39 and the site surface, and thus increases effective width of the foundation to equal or exceed maximum width of the form as measured across the bulges 39. Thus, both the marginal and the contact portions have an array of mesh openings extending thereacross and therealong. The openings of each portion can be equal for simplicity and are of a size sufficient to pass the flowable concrete or foundation mixture therethrough.

One important aspect of the invention relates to relative sizes of maximum sized aggregate in the concrete mixture and size of mesh openings in the mesh portions of the contact portion 60 and the marginal portions 47 and 49. Typical concrete has a maximum coarse aggregate size of about ¾ inch (20 cm), a medium aggregate size of about ⅜ inch (10 cm), and sand as a fine aggregate, plus Portland cement. If the mesh openings of the contact and marginal portions 47 and 49 are about 1 ½–2 inches (40–50 mm), maximum sized coarse aggregate will easily pass through the marginal portions and there will be little tendency for flow of concrete into the voids beneath the bulges 39 to be restricted until the slumped concrete attains the stable slump angle as shown. Also, the contact portion 60 should be held against the site surface, thus ensuring that the foundation form attains a desired shape as shown while enhancing adhesion to the site surface. The mesh openings can be produced by weaving the fabric with spaces between the thread portions to produce rectangular openings of the desired size. Alternatively, a conventional essentially closed fabric such as FABRENE (trade-mark) can be modified by punching or hot cutting circular or oval openings therein of the required size.

The flexible sheet form element 25 has a width which provides sufficient fullness to produce the footing width 28 which includes overall width of the contact portion 60 plus the additional width due to the slumped concrete 63 on each side of the portion 60. It can be seen that the transverse section of the finished footing is a generally truncated triangular section which contrasts with the overhanging, bulging form that would otherwise result without use of the slumped concrete. Thus the slumped concrete increases effective width of the finished foundation and thus provides more efficient use of the poured concrete than without the slumped concrete. The final estimated width 28 of the footing is selected to comply with building code requirements, and is clearly less than spacing between base plates 41 and 42 of the legs 33 and 34. The flexible sheet form element 25 is spaced from the plates 41 and 42 so that the slumped concrete 63 is clear of the plates and does not flow over the plates. Clearly, a small amount of concrete remaining on the plates is not a problem, but it is important that the plates do not bear excessive loads of the slumped concrete that would otherwise restrict their removal after the concrete has set.

As indicated earlier, the present invention can accommodate undulations in the site surface and these can be accommodated by adjustment in attachment locations of the edge portions 57 and 58 of the sheet form element to the longitudinal form supports so that width of the contact portion 60 will be essentially constant resulting in an essentially constant footing width 28. Clearly, any increase in the width 28 beyond that necessary for building code requirements reflects a waste of concrete. Any reinforcements or engineering attachments are fitted within the formed sheet form before pouring concrete, for example, reinforcing bars and seats 61 are shown supported on the contact portion 60. The flexible sheet form element is described in greater detail with reference to FIGS. 6–8.

Figure 4:
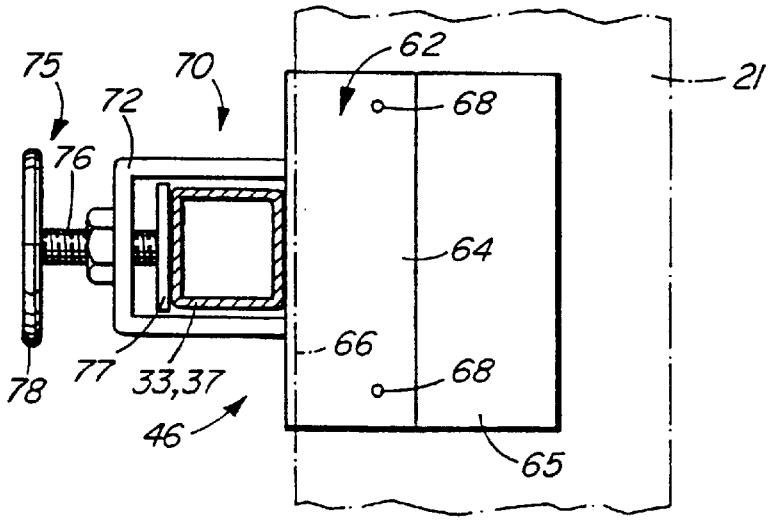
FIG. 4 is a simplified fragmented section generally on line 4—4 of FIG. 2 showing a first embodiment of a form connector and associated portions of the form supports.

Referring to FIGS. 2 and 4, the form connector 46 has a form support receiver 62 which is a generally U-shaped plate having generally horizontal upper and lower flanges 64 and 65 interconnected by a vertical web 66, shown in broken outline in FIG. 4. The lower flange 65 extends inwardly towards the plane 32 further than the upper flange 64 to provide support for the lower surface of the first longitudinal form support 21, shown in broken outline in FIG. 4. The upper flange 64 has a pair of nail openings 68 to receive nails (not shown) which temporarily retain the form support 21 within the form support receiver 62 with the support 21 being oriented so that width thereof is disposed horizontally. The form connector 46 further includes a connector clamp 70 which comprises a generally U-shaped bracket clamp 72 which is secured to the web 66 to define a rectangular opening which receives the upper portion 37 of the leg 33 as a sliding fit therein. The clamp portion further comprises a clamp member 75 which has a relatively coarse threaded shaft 76 carried in a complementary threaded opening in the clamp bracket 72. The clamp member 75 is rotatable by a handle 78 to clamp a jaw 77 of the form connector against the upper leg portion 37. The threaded shaft 76 is preferably a length of coil rod, which has a coarse, intermittent screw thread which is specially adapted to be self-clearing of concrete or other contamination while providing quick clamping and releasing as is well known in the trade. Clearly, by unscrewing clamp member 75, the form connector 46 is slidable along the leg portion 37 and can be positioned at essentially any appropriate location on the upper leg portion 37 to accommodate undulations in the ground as shown in FIG. 3. Thus it can be seen that the form connector 46 comprises the form support receiver 62 to receive the longitudinal form support 21 therein, and the connector clamp 70 secured to the receiver and being releasably clampable on the adjacent upper leg portion. The clamp 70 is infinitesimally adjustable vertically along the upper leg portion 37 to vary position of the longitudinal form support 21 to attain an exact position as determined by conventional levelling techniques. Also, it can be seen that the form support receiver 62 is located inwardly of the adjacent leg portion and within a vertical plane containing the tie member.

Figure 5:
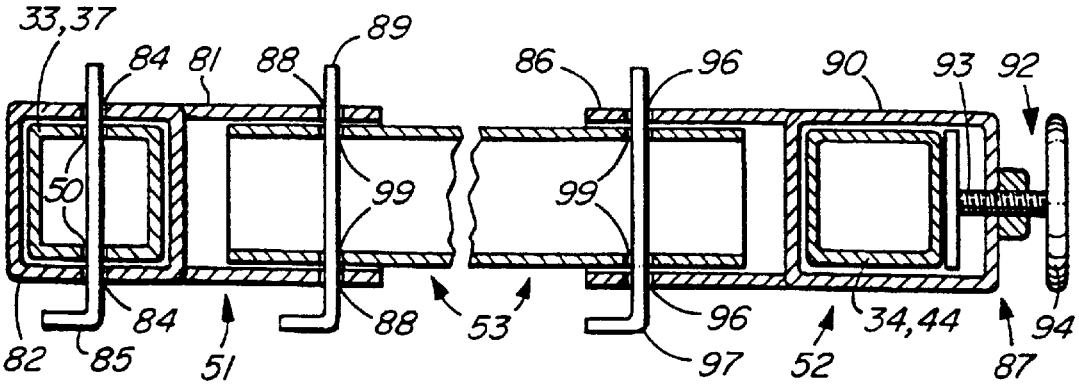
FIG. 5 is a simplified fragmented section generally on line 5—5 of FIG. 2 showing portions of a first embodiment of a leg tie, and associated portions of the form support, the leg tie being adjustable for different lengths.

Referring to FIGS. 2 and 5, the first tie portion 51 of the leg tie 48 has a first sleeve portion 81 and a slide portion 82, the portions being fabricated from generally square sectioned tubes of appropriate sizes and secured perpendicularly together, e.g. by welding. The slide portion 82 is a sliding fit on the upper leg portion 37 and has a pair of aligned openings 84 to receive a dowel 85 passing therethrough, which concurrently passes through an aligned pair of openings 50 in the upper leg portion, so as to locate the slide portion 82 at an appropriate position on the upper leg. As stated previously, exact location of the leg tie 48 is not critical and thus the tie portion 51 can be positioned incrementally at several positions along the upper leg portion dependent on spacing between the transverse openings 50. The rigid connection between the portions 81 and 82 ensures that, when the first tie portion 51 is secured rigidly to the upper leg portion 37 of the first leg by the dowel 85, the sleeve portion 81 extends generally perpendicularly from the upper leg portion and there is little movement of the sleeve portion relative to the upper leg portion. The sleeve portion 81 has a pair of aligned openings 88 which can receive a dowel 89 therethrough as will be described.

The second tie portion 52 has a second sleeve portion 86 and a tie clamp 87 similarly secured perpendicularly together to provide a rigid connection therebetween. The first and second sleeve portions 81 and 86 can be essentially identical to each other whereas the tie clamp 87 differs from the slide portion 82 by being infinitesimally adjustable and functions generally similarly to the connector clamp 70 of FIG. 4. Thus, the tie clamp 87 includes an open rectangular frame 90 which has a width which is a sliding fit on the upper portion 44 of the leg 34 and also has a clamp member 92 to releaseably secure the leg tie to the leg portion 34. The clamp member 92 has a threaded shaft 93 and handle 94 and is manually adjustable to clamp the frame 90 in essentially any particular location on the leg 34 in a manner similar to the connector clamp 70 of FIG. 4. It is added that the second tie portion is clamped on the upper leg portion of the second leg at a position which ensures that both upper leg portions are generally vertical, while each leg portion is supported generally equally on the site surface. Clearly, any lateral slope between the first and second leg members would result in the upper leg portions being inclined to the vertical if it was not possible to finely adjust the particular location of the second tie member 52 on the upper leg portion 44. As will be described with reference to a second embodiment in FIG. 10, the invention provides a relatively wide range of adjustment to accommodate lateral sloping of the site.

The second sleeve portion 86 has a pair of aligned openings 96 which receive a dowel 97 passing therethrough generally similarly to the openings 88 and dowel 89 of the first tie portion. Thus it can be seen that the second tie portion has an open frame 90 which can be secured rigidly to the upper leg portion of the second leg at essentially any position so that the second sleeve portion can extend generally perpendicularly from the upper leg position when disposed vertically in a manner similar to the first tie portion.

The third tie portion preferably comprises a square-section tube having a size complementary to the first and second sleeve portions 81 and 86 so as to be telescopically mounted with respect to the first and second tie portions. This is to permit telescopic extension and retraction of the leg tie 48 itself, thus varying horizontal spacing between the legs 33 and 34. The third tie portion has a plurality of aligned pairs of transverse openings 99 therein, in which one pair thereof can be aligned with corresponding aligned openings 88 in the first sleeve portion 81, and a second pair thereof can be aligned with the openings 96 in the second sleeve portion 86. Each two pairs of aligned openings can receive the dowels 89 and 97 to pass therethrough so as to prevent unintentional movement between the third tie portion and the first and second tie portions. Thus, it is seen that the leg tie is telescopically extensible and retractable along a substantially horizontal axis thereof to permit variation in spacing between the legs to accommodate footings of different widths.

FIGS. 1, 2 and 6–8

In FIG. 2, the first and second edge portions 57 and 58 of the flexible sheet form element 25 are stapled to and supported by the longitudinal form supports 21 and 22 respectively, each of which in turn is supported by at least two of the transverse form supports 15 to locate the flexible sheet element in required locations along the longitudinal axis 17 of the foundation. As will be described, it is important to ensure that the flexible sheet form element 25 is relatively symmetrically located with respect to the longitudinal axis 17 and the form supports, and this is attained by providing a grid of longitudinal guidelines or equivalent indicia on the sheet form element as will be described with reference to FIG. 6. In FIG. 1, for convenience of description, three specific fragmented portions of the foundation are designated as first, second and third footing portions 101, 102 and 103 which are adjacent a right-angled corner of the building and a right-angled intersection of two walls of the building. This provides two different examples of perpendicular interconnections of lengths of the flexible sheet form element 25, i.e. an L-connection and a T-connection.

Figures 6, 7:
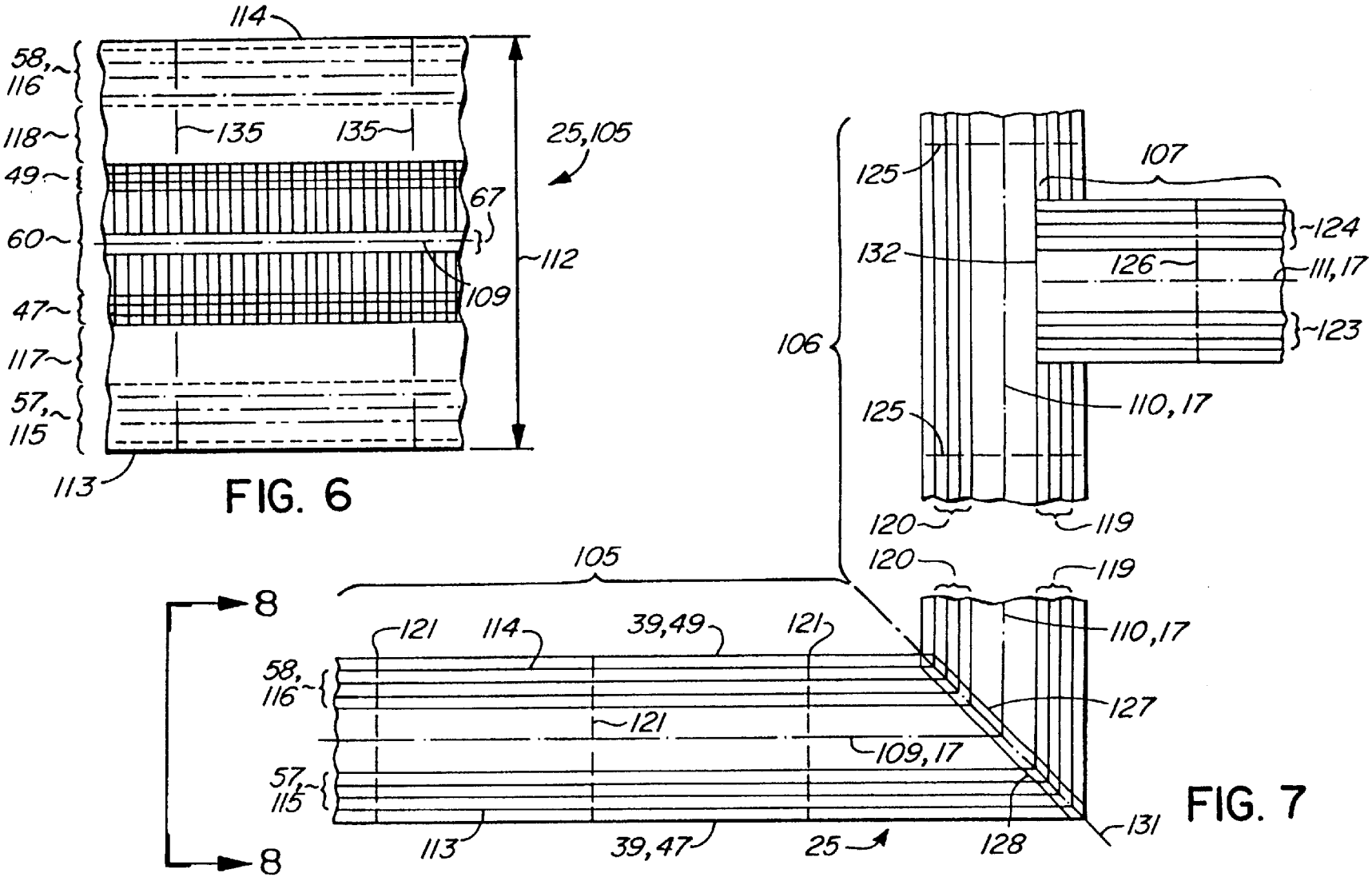
FIG. 6 is a simplified fragmented top plan of a portion of a flexible sheet form element according to the invention shown flattened prior to installation into the form supports of the invention.
FIG. 7 is a simplified top plan of three adjacent portions of the flexible sheet form element of FIG. 6, the form element being shown folded and joined at two intersections prior to installation on the form supports.

Referring to FIG. 7, the sheet form element 25 comprises at least first, second and third flexible sheet form portions 105, 106 and 107 respectively which are provided to produce the first, second and third footing portions 101, 102 and 103 of FIG. 1. The first, second and third sheet portions 105, 106 and 107 have corresponding first, second and third centre lines 109, 110 and 111 respectively as shown, which intersect each other at right angles as shown, to produce right angled connections between adjacent footing portions. Clearly the sheet portions could intersect at other non-perpendicular angles of intersection depending on the corresponding angles of intersection of the footing portions.

Figure 8:
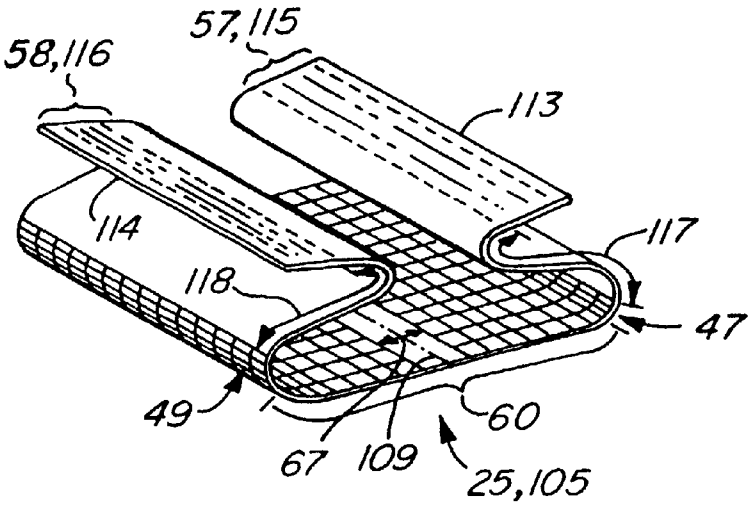
FIG. 8 is a simplified fragmented perspective of a portion of the flexible sheet form element as shown folded and generally as viewed from line 8—8 of FIG. 7.

Referring to FIGS. 6 and 8, the first sheet portion 105 has first and second parallel longitudinally extending first and second edges 113 and 114 adjacent respective first and second edge portions 57 and 58 respectively. Clearly, transverse spacing between the edges 113 and 114 of the edge portions defines width 112 of the sheet form element 25 when flattened. The first sheet portion 105 has first and second sets of longitudinal guidelines 115 and 116, the first set 115 being located within the first edge portion 57 on an outer side of the foundation, and the second set 116 being located within the second edge portion 58 on an inner side of the foundation. The set of guidelines 115 has a plurality (eg. 4–6) of laterally spaced apart guidelines disposed parallel to the centre line 109, adjacent lines being separated by about 1 inch (25 mm). The guidelines are distinguished from each other by suitable means, for example, different colours, line type such as full lines, broken lines, chain-dot lines, etc., or lines having numbers or letters thereon. The second set 116 of longitudinal guidelines on the opposite side of the sheet form element are similarly identified. In this way a particular guideline having a specific distinguishing feature in the first edge portion 57 is at the same distance from the centre line 109 as a similarly identified or equivalent guideline in the second set of guidelines 116 in the second longitudinally extending edge portion. This provides a means of dividing the sheet form element into a series of different effective widths which are all positioned symmetrically with respect to the centre line.

The contact portion 60 of the sheet form element 25 is spaced inwardly of innermost longitudinally extending guidelines of the first and second sets 115 and 116 by the first and second marginal portions 47 and 49 plus first and second intermediate portions 117 and 118 respectively of the sheet form element. Referring to FIG. 2, the intermediate portions 117 and 118 extend upwardly from above the bulges 39 of the footing and upwards generally towards the second longitudinal form supports and thus there is no need for graduations or indicia in these intermediate portions. The portions 117 and 118 can be water permeable to accelerate concrete consolidation.

The first sheet portion 105 also has a plurality of transverse guidelines 121 spaced longitudinally apart at transverse stations disposed along the sheet of fabric as shown. The transverse guidelines 121 are disposed perpendicularly to the centre line 111 and spaced equally apart at a spacing of about 1 to 2 feet (30 to 60 cm) to assist in positioning the sheet form element accurately and symmetrically along the foundation axis.

Similarly, the second sheet portion 106 has first and second sets of longitudinal guidelines 119 and 120 disposed parallel to and equally spaced from the second centre line 110. Similarly, the third portion 107 has first and second sets of longitudinal guidelines 123 and 124 disposed parallel to and spaced equally from the third centre line 111. Similarly, the second and third sheet portions 106 and 107 have transverse guidelines 125 and 126 respectively corresponding to the guidelines 121 of the first sheet portion 105. For uniformity, usually the flexible sheet elements for each length of foundation are produced from the same marked sheet of geotextile material, and thus all of the portions of sheet form element are compatible and thus equivalent guidelines of each set of each sheet portion are equally spaced from the corresponding centre line.

The first and second sheet portions 105 and 106 have complementary mitred edges 127 and 128 respectively which are cut at 45 degrees to each other and when positioned as shown in FIG. 7, overlap each other at equal distance on opposite sides of an axis 131 of the mitre to form a L-intersection. The overlap can be between about 1–3 inches (25–75 mm) so as to provide an adequate seal between adjacent portions of flexible sheet fabric to reduce leakage of flowable concrete foundation material therethrough. In addition, staples (not shown) can be used to stitch together or otherwise secure adjacent portions of the mitred edges 127 and 128 so as to reduce leakage of concrete therethrough. Ends of the mitred edges arc located by corresponding longitudinal form supports at the corners of the building as shown in FIG. 1.

The third sheet portion 107 has a perpendicularly cut end edge 132 which is positioned so as to be aligned with an innermost guideline of the first set 119 of guidelines. Portions of the third sheet portion 107 adjacent the edge 132 can be cut and secured by stapling to adjacent portions so as to reduce leakage of concrete therethrough while providing a continuous concrete connection across the T-intersection. Thus, to accommodate various corners of a foundation as shown in FIG. 1, adjoining portions of the flexible sheet form element are cut appropriately and adjacent portions secured together with staples or other stitching means to reduce flow of concrete therethrough as will be described in the operation.

Operation

The form apparatus 12 can be installed on a building site surface 10 after minimal preparation of the site surface to remove excessive vegetation, large rocks, etc. Generally, less site preparation is required for the present invention than for conventional wood concrete forms as the present invention can accommodate undulations of site surface far in excess of that of conventional rigid foundation forms. The first and second longitudinal form supports 21 and 22, which are typically convenient lengths of conventional dimensioned lumber such as 2×4's or 2×6's, are laid out on opposite sides of and at appropriate distances from the axis 17 of the foundation. The brackets 23 and 24 are nailed as required to form a conveniently sized framed section of the foundation for installation. The transverse form supports 15 are then positioned at suitable spacings eg. about 5–10 feet (1.5–3.0 metres) along the axis 17, with the leg tie 48 adjusted to an appropriate length to provide a foundation footing of appropriate size.

The longitudinal form supports 21 and 22 are then fitted into the form connectors 46, which are adjusted vertically along the respective upper leg portions of the transverse form supports so that the longitudinal form supports are all disposed within a generally horizontal plane. If the building site has been excavated down to hard pan, the base plates 41 and 42 of the transverse form supports usually prevent excessive sinking of the transverse form supports. However, if loose fill has been used to level the site, compacting of any excessively loose fill under the base plate might be required to prevent excessive sinking of the base plates, which could cause the longitudinal form supports to move out of the horizontal plane. The horizontal plane of the form supports 21 and 22 is established using conventional builders' levelling techniques such as laser alignment systems, builder's levels, etc. As shown in FIG. 3, longitudinal undulations of the foundation, that is undulations extending along the axis 17, can be accommodated easily by vertical adjustment of the form connectors 46. As will be described with respect to FIG. 10, lateral undulations or sideways sloping of the site surface can also be accommodated with the present invention.

Preferably, the longitudinal and transverse form supports are fitted to extend around the complete foundation area, after which a roll of the flexible sheet form element 25 is cut to appropriate lengths and at appropriate angles to fit the foundation as follows. For example, the flexible sheet form portions 105, 106 and 107 (FIG. 7) are positioned at appropriate locations on the site surface so that the centre lines 109, 110 and 111 etc. correspond with appropriate longitudinal foundation axes 17. To prevent inadvertent movement of the sheet portions, eg. due to wind or accidental disturbance by workers, the sheet portions are secured on the site surface by nailing through the central portion 67 into the hard pan or site surface under the sheet, or by placing stones or other ballast on the sheet portions.

Preferably, the sheet form element material is provided in a pre-folded "double Z-shape" in which each of the edge portions 57 and 58 is folded so that innermost portions of the edge portions are symmetrical of and disposed generally adjacent the centre line 109.

This folding facilitates cutting of ends of the sheet portions and deforming the sheet portion into the shape generally as seen in FIG. 8, which is attained immediately prior to securing the edge portions 57 and 58 to the appropriate longitudinal form supports 21 and 22. The transverse guidelines 121 assist in locating the sheet portion 105 symmetrically with respect to the longitudinal and transverse form supports to maintain symmetry of the flexible sheet form element 25 which is attached to the form supports as follows.

The edge portions 57 and 58 of the flexible form element 25 are drawn upwardly and passed around oppositely facing inner edge faces of the longitudinal form supports 21 and 22 as shown in FIG. 2. At this stage, it is necessary to maintain accurate control of "the fullness" of the flexible sheet to maintain the adequate footing width when the sheet is supported along the edge portions to hang loosely therefrom, and then deforms when it receives the flowable foundation mixture. This is attained by using the sets of longitudinal guidelines 115, 116, etc. as an indication of "effective width" of the fabric at a particular station on the sheet element defined by the particular transverse form support.

If the transverse form support is on laterally level ground at a particular station as shown in FIG. 2, the flexible sheet form element is stapled to the longitudinal form supports at positions defined by equivalent longitudinal guidelines so that the connections are equally distant from the centre line of the flexible sheet form element. Spacing between the equivalent guidelines defines effective width of the sheet element. In other words, to ensure symmetry and adequate fullness in the fabric, a particular longitudinal guideline in the first set of guidelines 115 is secured to the first longitudinal form support 21, and the equivalent longitudinal guideline in the second set of guidelines 116 is secured to the second longitudinal form support at a perpendicularly opposite position on the sheet form. In this way, any excess material of the sheet form extending upwardly beyond the line of staples to an adjacent edge on one side of the sheet is equal to excess material of the sheet form on the opposite side of the sheet. Thus, the longitudinal guidelines are of importance in ensuring accurate and symmetrical location of the sheet form element with respect to the longitudinal form supports 21 and 22.

If there are longitudinal undulations in the site surface, for example as shown in FIG. 3 where the height of the longitudinal forms above the site surface varies along the length of the form apparatus 12, to maintain the required width of the footing it is important that effective width of the sheet form can be varied appropriately. For example, to accommodate a depression in the site surface, local effective width of the sheet form is increased to provide additional "slackness", ie. to increase the local perimeter of the form, to provide sufficient additional height of the footing without detracting from overall width of the footing. This is attained by stapling the sheet form element at positions further from the centre line of the element, that is on the longitudinal guidelines closer to the edges of the sheet form element. If the site surface slopes only in the longitudinal direction, and does not slope laterally or transversely, i.e. to one side of the form, the sheet form element is stapled at positions on opposite sides equally spaced from the centre line, that is it is stapled symmetrically at equivalent guidelines on each side of the centre line.

Figure 10:
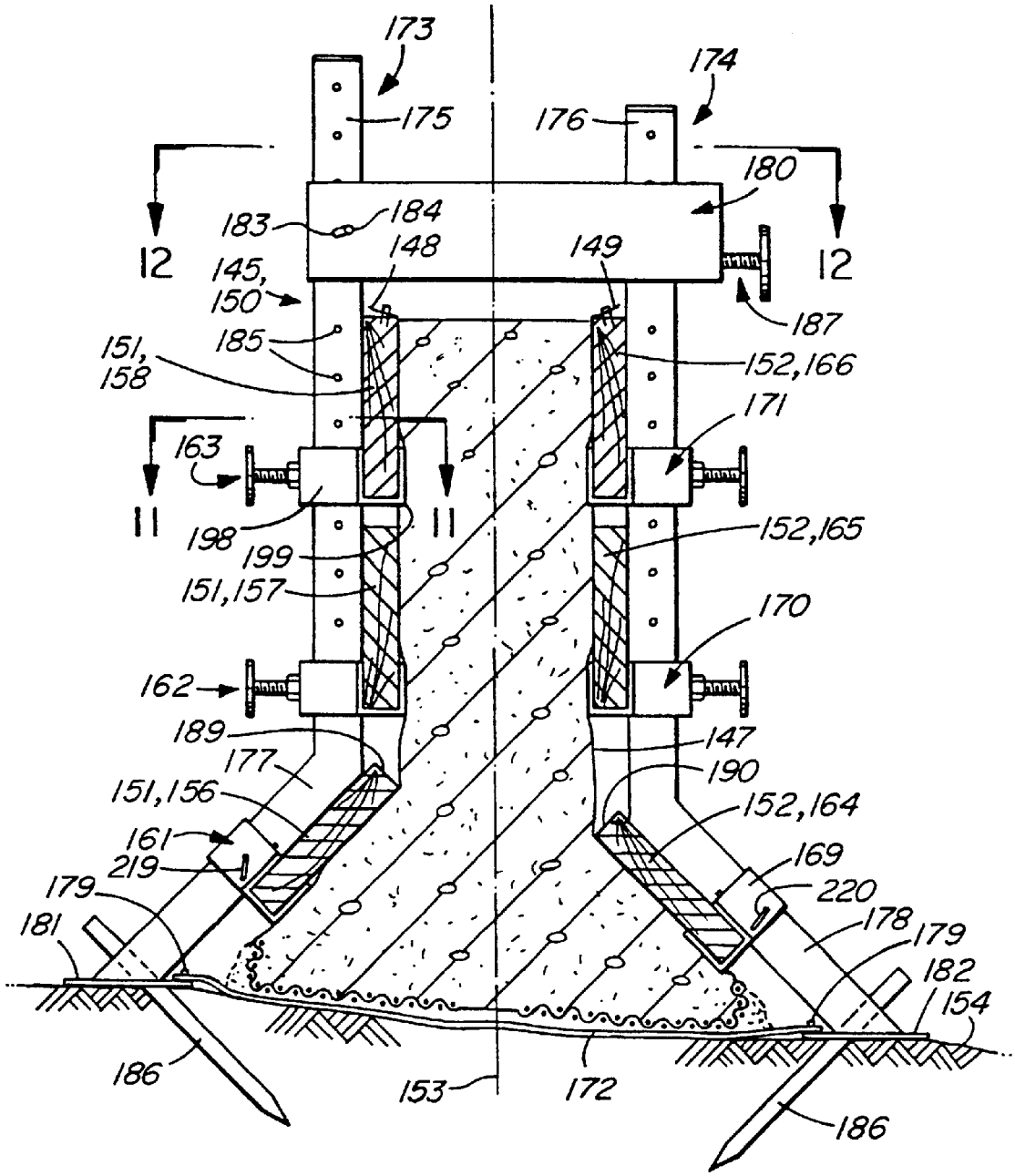
FIG. 10 is a simplified fragmented transverse section on line 10—10 of FIG. 9 showing the second embodiments of the transverse and longitudinal form supports after pouring the concrete.

To accommodate lateral or transverse sloping, for example, as shown in FIG. 10, as before, the flexible sheet form element is secured to the ground using nails or spikes passing through the central portion 67 adjacent the centre line 109 of the sheet into the approximate location of the foundation axis 17, thus ensuing symmetrical placement of the sheet form with respect to the foundation axis. However, additional care is taken to increase the effective local width of sheet form material on the lowest side of the form supports by stapling the sheet form element asymmetrically with respect to the centre line thereof. Thus, on the lowest sides of the foundation footing, longitudinal guidelines closer to the edge of the sheet form are used for securing the flexible sheet form element to the longitudinal form support.

The above procedure is repeated for all lengths of the proposed foundation, ensuring that where the foundation changes direction at a corner, or there is an intersecting wall, edges of adjacent sheet form elements are "spliced" into place by stapling adjacent the edges to reduce leakage of concrete therethrough.

When the complete periphery of the foundation sheet form has been stapled to the longitudinal form supports, the sheet form element provides an elongated generally U-shaped container with an opening extending along an upper portion thereof, the opening having a width equal to width of the resulting upper surface 54 of the footing. If the reinforcing bars 61 (FIG. 2) or other engineering supports or connections are required, these are now located within the container. At this stage, concrete can be poured into the opening between the longitudinal form supports, the concrete flowing to deform the sheet form element into a shape generally similar to that shown in FIG. 2. The fluidity of the concrete mixture, the relative positions of the longitudinal form supports with respect to the site surface, the width of the flexible sheet form and forces from the wet concrete determine final shape of the form, which shape has the overhanging bulges 39 which have lower portions formed of the marginal portions 47 and 49 which produce the voids.

As the concrete fills the form, pressure of the concrete against the fabric form increases and eventually at least some portions of the concrete mixture flow through the mesh openings of the marginal portions 47 and 49, as well as the contact portion 60. Any voids between the contact portion and the site surface are quickly filled with at least fine aggregate, whereas the concrete mixture flows through the marginal portions until accumulation of slumped concrete 63 on the site surface blocks the mesh openings in the marginal portions thus preventing further flowing of the concrete. It can be seen that the contact portion 60 provides a controlled discharge portion to permit filing of voids between the contact portion and the site surface immediately beneath the contact portion, and the marginal portions 47 and 49 also provide controlled discharge portions which can pass therethrough a portion of the foundation mixture to form the slumped concrete 63. It can be seen tat the slumped portion 63 of the foundation mixture which has passed through the controlled discharge portion of the marginal portions 47 and 49 extends between the site surface and foundation mixture within the flexible sheet form element to essentially eliminate the voids under the bulges 39 and thus increase width of the foundation mixture in contact with the site surface, thus reducing bearing pressures. The concrete mixture passing through the contact portion 60 improves adhesion ie. shear resistance between the foundation and the site surface.

As previously stated, an important aspect of the invention relates to relative size of openings in the mesh portions of the contact portion 60 and maximum aggregate size in the concrete mixture. If the mesh opening size of the contact portion 60 is excessively larger than the maximum aggregate size and/or excessive vibration is employed, concrete mixture could continue to flow through the mesh openings in the contact portion because hoop tension in an upper portion of the flexible sheet form fabric could draw the contact portion generally upwardly through the mass of concrete in the form. If the contact portion rises out of contact with the site surface, there is a loss of control of the flow through the sheet form element, and the desired shape of the resulting foundation form is lost, with a corresponding loss of strength in the footings and wastage of concrete. Consequently, one important aspect of the method is that discharge of a portion of the concrete mixture through the contact portion 60 is controlled sufficiently so as to maintain the contact portion in contact with the site surface 10, thus maintaining desired footing profile or "footprint". However, the control of concrete flow through the marginal portions 47 and 49 appears to be less critical than that through the contact portion 60 because the slumped concrete 63 eventually stops flowing through the marginal portions 47 and 49.

When the concrete has set, the transverse and longitudinal form supports are removed as follows while leaving the sheet form 25 in place as it is a relatively low cost item and is essentially impossible to remove. To avoid breaking the longitudinal form supports, any brackets 23 and 24 securing the longitudinal form supports together will be first separated to facilitate handling of the lengths of lumber. The dowels 89 and 97 can be removed from the leg ties, permitting separation of upper portions of the legs from each other. The spikes 43 can be removed and usually the legs 33 and 34 can be pulled sideways away from the finished foundation, concurrently removing the longitudinal form supports 21 and 22 which would be retained in the form support receivers. As the longitudinal and transverse form supports are protected against concrete contamination by the flexible sheet form 25, the form supports 15, 21 and 22 can be reused without excessive cleaning.

Thus, in summary it can be seen that the method according to the invention, for installing the building foundation comprises the following steps:

supporting at least the first and second transverse form supports 15 directly on the ground 10 and spaced apart along a longitudinal foundation axis;

locating at least first and second longitudinal form supports 21 and 22 on opposite sides of the foundation axis, and connecting each longitudinal form support to said at least two transverse form supports 15 so that at least one longitudinal form support is positioned above the ground on each side of the foundation axis and extends between the transverse form supports;

connecting the first and second longitudinally extending edge portions 57 and 58 of the flexible sheet form element 25 to the first and second longitudinal form supports so that the sheet form element is deformed into a general U-shape and extends longitudinally between the first and second transverse form supports 15, and laterally between the first and second longitudinal form supports 21 and 22 and is at least supported partially by the longitudinal form elements; and pouring a settable, flowable foundation mixture into the at least partially supported flexible sheet form element so that at least a mid-portion of an intermediate portion of the flexible sheet form element is at least partially supported on the ground when the flexible sheet form element deforms into the general U-shape due to weight of the settable and flowable foundation mixture.

Thus it can be seen that the method further comprises supporting one leg of each form support on the ground on opposite sides of the foundation axis, and adjusting the leg tie of each form support to extend substantially transversely across the longitudinal foundation axis to cooperate with the respective leg of the support form to connect the respective legs rigidly together. In addition, it can be seen that to accommodate variations in height of the ground, the leg tie is adjusted vertically with respect to at least one leg of a particular transverse form support and is then locked with respect to said at least one leg so as to locate the legs generally vertically and the leg tie generally horizontally.

In summary, it also can be seen that the method according to the invention further comprises controlling discharge of a portion of the foundation mixture through at least one controlled discharge portion of the flexible sheet form element. The portion of foundation mixture discharged through the controlled discharge portion contacts the site surface to form a connection between the site surface and the foundation material contained within the flexible sheet form element. The controlled discharge portion of the contact portion essentially fills any voids between the contact portion and the site surface, thus improving adhesion and shear resistance between the foundation and the site surface. The sheet form element is permitted to deform to produce at least one bulge overhanging the site surface adjacent an edge of the contact surface to define a void adjacent the edge of the contact portion and between the bulge and the site surface. The controlled discharge portion of the marginal portions located on each side of the contact portion extend upwardly therefrom so that concrete passing through the marginal portion fills the void that would otherwise be formed between the flexible sheet form element and the site surface.

If a separate wall form is to be installed after the concrete is set, the upper surface 54 of the concrete footing is as generally shown in FIG. 2. This permits nails 139 to be driven through the longitudinal form supports 21 and 22 and into the partially set concrete footing as shown in FIG. 2. After nailing the longitudinal form supports, the transverse form supports 15 can be quickly and easily removed by removing the dowels 89 and 97 from the openings in the leg tie 48 to permit separation of the leg tie 48 from the legs 33 and 34. The legs can be removed after removing the spikes 43 and 44 from the ground. A first rigid sheet wall form 140 (broken outline) is then nailed to an inner face of the first longitudinal form support 21, which now serves as a kicker plate, and a second rigid sheet wall form 141 is located adjacent an inner face of the second longitudinal form support 22. The rigid wall forms 140 and 141 are plywood sheets and conventional concrete form ties 142 are then fitted in openings in the rigid sheet wall forms so as to extend between the rigid wall forms to locate them at a required spacing in a conventional manner. The rigid wall forms are positioned to be vertical and supported in a conventional manner to resist outward forces of the concrete, and are then ready to receive a second pour of concrete.

Alternatively, if the foundation form is to be used to produce only footing with a platform to receive horizontal lumber, the concrete is usually poured so that the upper surface 54 thereof can be levelled using conventional methods. When the concrete is cured, the transverse form support is disconnected as previously described permitting installation of the wall directly on the poured form.

Alternative

Controlled discharge portions of the fabric of the sheet form element 25 have mesh openings to provide the mesh portions for the portions 47, 49 and 60, and the remaining areas of the fabric are either permeable to water or impermeable to water. If the fabric is permeable to water, water from the concrete can pass therethrough, thus accelerating consolidation of the concrete which would permit a shorter time interval between first and second pours of concrete. However, geotextile fabric that is permeable to water tends to adhere to concrete and thus is difficult to remove therefrom. Removal of form fabric can be necessary in some applications where a concrete pad or other structure is to be poured adjacent the flexible sheet foundation form. On the other hand, impermeable fabric is easier to remove from adjacent the fabric footing. In addition, impermeable fabric can waterproof the footing against seepage of ground water, and this has advantages in some applications.

The first embodiment 12 is mechanically relatively simple and is sufficiently versatile to enable pouring of a footing only in a single pour, and a footing and a short wall in two pours or other variations thereof. The use of the telescoping leg tie 48 permits variations in lateral spacing between the upper leg portions so as to provide a footing (and wall if used) of different widths. However, it is not always necessary to provide such versatility, and if desired, the leg tie could be made of fixed length so that the legs are always located at the same lateral spacing as will be described in a first alternative following. In addition, in the present invention, longitudinal undulations in the site surface are accommodated by varying position of the longitudinal form supports on the transverse form supports so that the resulting longitudinal form supports are all disposed within a horizontal plane, and longitudinal site undulations are accommodated by variations in height of the footing along the length of the footing. In the first alternative to be described, longitudinal undulations in the site surface are accommodated by variations in wall height above the footing, and the footing has an essentially constant height.

FIGS. 9–12

A second embodiment 145 of a building foundation form apparatus according to the invention differs from the first embodiment 12 of FIGS. 1–5 by providing additional options to those shown in the first embodiment, plus some simplifications with corresponding limitations. The second embodiment 145 includes a flexible sheet form element 147 which has first and second parallel, longitudinally extending first and second edge portions 148 and 149. In contrast to the first embodiment 12 which produces a footing with or without a short wall, the second embodiment produces a footing with a relatively tall wall, and thus the flexible sheet form element 147 has a width far greater than that required for the first embodiment, but otherwise is generally similar to the sheet form element 25. Thus the element 147 has undesignated contact and marginal portions provided with appropriately sized mesh openings. Because the wall portion of the second embodiment is much higher than that of the first embodiment, forces are increased and the apparatus has, in general, a greater size than the first embodiment and thus, in general is more costly to produce and initially more time consuming to set up. However, the second embodiment eliminates the requirement for installing the second set of conventional rigid sheet forms on top of the poured footing, and thus eliminates a second installation of form work as will be described.

Figure 9:
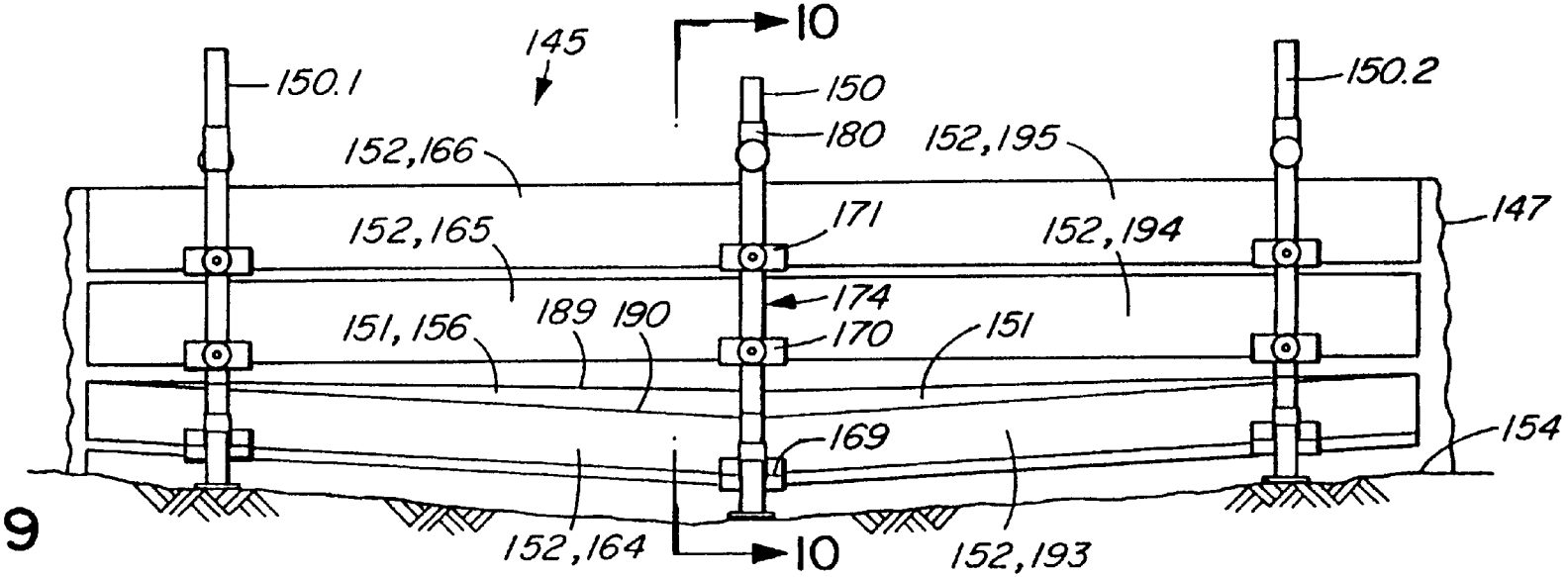
FIG. 9 is a simplified fragmented side elevation of a second embodiment of the invention showing three second embodiments of transverse form supports supporting longitudinal form supports of a form apparatus used to produce a combined footing and wall.

Referring to FIGS. 9 and 10, the second embodiment 145 has a plurality of second embodiments of transverse form supports 150 which are spaced longitudinally apart along the foundation and support a plurality of first and second longitudinal form supports 151 and 152, which are not completely symmetrical about a vertical plane 153. The form supports 151 and 152 each comprise multiple support strip members which are generally similar to the form supports 21 and 22 of FIG. 1, and are stacked lengths of dimensioned lumber supported at appropriate locations on the transverse form supports 150. The second embodiment 145 is supported on a site surface 154 which has longitudinal undulations, i.e. the site slopes longitudinally as shown in FIG. 9, and also has transverse undulations, i.e. the site slopes transversely or laterally as shown in FIG. 10. The longitudinal form support 151 comprises lower, intermediate and upper lengths of lumber 156, 157 and 158 respectively which are releasably connected to each transverse form support 150 by lower, intermediate and upper form connectors 161, 162 and 163 respectively. The second longitudinal form support 152 comprises similar lower, intermediate and upper lengths of lumber 164, 165 and 166 located on each transverse form support 150 by corresponding form connectors 169, 170 and 171 respectively.

Referring specifically to FIG. 10, the transverse form support 150 has first and second legs 173 and 174 having respective upper leg portions 175 and 176 connected at an angle to respective lower leg portions 177 and 178 generally similarly to the first embodiment. A fixed length leg tie 180 extends between the upper portions 175 and 176 to connect the upper portions rigidly together and this is described in greater detail with reference to FIG. 10. The lower leg portions 177 and 178 have first and second base plates 181 and 182 respectively which are similar to the plates 41 and 42 (FIG. 2) and are located on opposite sides of the foundation and, due to lateral or transverse sloping of the site, are located at different heights. Thus, upper portions of the legs are also at different heights corresponding to the lateral or transverse slope.

Because the second embodiment 145 can produce a higher wall than the first embodiment 12, in general, outwards forces acting on the transverse form supports 150 are greater than corresponding forces on the transverse form support 15. In order to prevent outwards movement of the lower portions of the leg portions, a non-elastic ground tie 172 can be connected to extend transversely between the base plates 181 and 182 of the lower leg portions. Each of the base plates has a connecting peg 179 extending upwardly therefrom and adapted to be releasably received in an opening (not shown) at the adjacent end of the ground tie 172, thus providing a releasable complementary connector between ends of the ground tie and each base plate. The ground tie is typically a flat strip of thin metal adapted to pass under the sheet form element 147, as shown in FIG. 10, and usually remains in place when the transverse form is removed after the concrete has set. Thus the ground tie serves as a leg restricter extending between lower leg portions of the transverse form support to restrict outward movement of the lower leg portions. Thus, upper and lower portions of the legs are prevented from spreading outwardly by the leg tie 180 and the ground tie 172 respectively. In some circumstances, the ground tie may be omitted and the legs can be prevented from outwards movement by spikes 186 driven through appropriate openings in the base plates into the hard pan, similarly to the spikes 43 of FIG. 2.

The leg tie 180 has a pair of aligned openings 183 at a first end portion thereof which receive a dowel 184 passing through an aligned pair of openings 185 of an array of similar openings provided in the first upper leg portion 175. The dowel 184 and openings 185 fix one end of the leg tie with respect to the first leg 173, and a second opposite end portion of the leg tie has an adjustable tie clamp 187 to releasably clamp the upper leg portion 176 at a position which is closer to the upper end thereof than the leg portion 175 to accommodate the transverse sloping of the site surface 154.

Positions of the upper form connectors 163 and 171, and intermediate form connectors 162 and 170 are adjusted on the upper leg portions 175 and 176 respectively so that the corresponding upper and intermediate lengths of lumber 158, 166; 157, 165 on opposite sides of the foundation are disposed at the same height, so as to be within respective spaced apart horizontal planes. In contrast, the lower form connectors 161 and 169 are adjusted relative to the lower leg portions 177 and 178 respectively so that the lower lumber lengths 156 and 164 are positioned generally equally with respect to the lower portions, that is the connectors 161 and 169 are located at a generally mid position of each lower leg portion and thus follow generally the longitudinal site undulations as shown in FIG. 9.

When the lower lumber lengths are located adjacent the respective mid positions, an upper edge face 189 of the lower lumber length 156 is positioned so as to be higher than an upper edge face 190 of the lower lumber length 164 due to the transverse site undulation, i.e. the lengths 156 and 164 are located at generally equal spacings from the site surface. The difference in height between the upper edge faces 189 and 190 is also shown in FIG. 9 which also shows that the lower lengths 156 and 164 follow the general downwards longitudinal undulation of the site surface to the transverse form support 150 as shown. The second longitudinal form support 152 also includes similar lower, intermediate and upper lumber lengths 193, 194 and 195 which are located adjacent the second leg 174 but on an opposite side of the form support 150 from the lengths 164, 165 and 166. FIG. 9 shows the intermediate and upper lumber lengths 194 and 195 are aligned both horizontally and vertically with the corresponding lengths 165 and 166 so as to provide generally aligned, co-planar surfaces. In contrast, the lower lumber length 193 is connected at the lower form connector 169 and is inclined generally upwardly towards the transverse form support 150.2 which is disposed at a higher position on the site surface than the support 150 as shown. Thus, in contrast to the first embodiment which has a variable height footing, longitudinal undulations in the site surface are accommodated in the second embodiment by variations in wall height from a generally fixed height footing.

As best seen in FIG. 10, when viewed axially the lower lumber lengths 156 and 164 (which form lower portions of the first and second longitudinal form supports) are inclined at angles generally equal to the angles of the lower leg portions and are adapted to control position of adjacent footing portions of the flexible sheet form element 147 as follows. The lengths 156 and 164 displace the form from a generally unconstrained curved shape similar to that shown in FIG. 2, to a generally constrained triangular shape as shown in FIG. 10 which reduces volume of concrete required to produce a footing having a given width. This is appropriate where building code requirements permit reduction of volume of concrete in the footing, and is simple because it requires only providing the additional lower lumber lengths 156 and 164. This is appropriate if reduction in volume of concrete is more important than the additional time required to fit the lumber lengths. Alternatively, the lengths 156 and 164 can be removed and the lengths 157 and 165 could be positioned at lowest positions of the upper leg portions.

Figure 11:
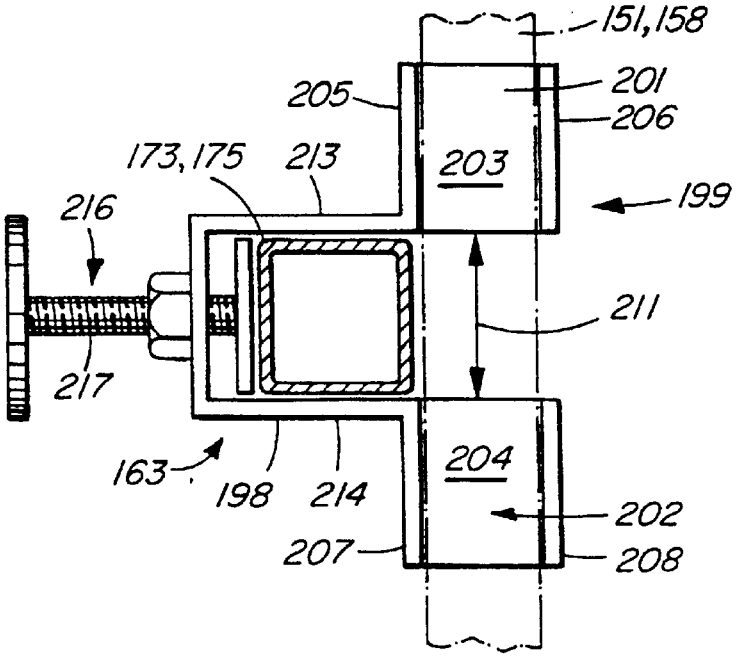
FIG. 11 is a simplified fragmented section on line 11—11 of FIG. 10 showing a second embodiment of a longitudinal form connector and associated portions of the form supports.

With reference to FIGS. 10 and 11, the form connector 163 has a clamp portion 198 and a form support receiver 199, and functions generally similarly to the form connector 46 of FIGS. 2–5, except that clamping forces to clamp the connector 163 to the leg portion 175 are also used to clamp the longitudinal form 151 to the form support receiver, and thus nails passing through the nail openings 68 of FIG. 4 are eliminated. The form support receiver 199 comprises a pair of aligned U-shaped portions 201 and 202 which have aligned web portions 203 and 204 which support weight of the upper lumber length 158 thereon (broken outline). The U-shaped portion 201 has a pair of spaced vertical flanges 205 and 206 extending upwardly from the web portion 203, and the portion 202 has similar vertical flanges 207 and 208 extending upwardly from the web portion 204, so as to be aligned with the flanges 205 and 206 as shown. Oppositely facing ends of the flanges and web of the portion 201 are spaced apart from oppositely facing ends of the flanges and webs of the portion 202 by a spacing 211 which is somewhat greater than width of the upper leg portion 175 of the leg 173. The clamp portion 198 is generally U-shaped and has a pair of parallel flanges 213 and 214 secured to the vertical flanges 205 and 207 respectively of the form support receiver 199 so as to define a generally rectangular-sectioned opening to receive the upper leg portion 175 therein as a sliding fit. The clamp portion has a clamp member 216 which is similar to the clamp member 75 and has a threaded shaft 217 threadable engaging the clamp portion 198 for movement with respect to the leg portion 175.

In operation, the upper form connector 163 is moved laterally inwardly past the upper leg portion 175, and the upper lumber length 158 can be fitted within the U-shaped portions 201 and 202 of the receiver. The clamp member 216 is manually rotated so as to clamp the upper leg portion 175 between the clamp member 216 and the upper lumber length 158. This secures the upper lumber length with respect to the leg without requiring nails, and thus permits easy and infinitesimal vertical adjustment of the dimensioned lumber.

Referring again to FIG. 10, the upper form connector 171 and the intermediate form connectors 162 and 170 are generally similar to the form connector 163. In contrast, the lower form connectors 161 and 169 do not have a clamp member, but instead rely on dowels 219 and 220 respectively which pass through aligned openings in the form connector and lower leg portions 177 and 178 respectively so as to locate the lower lumber lengths at incrementally spaced apart positions depending on spacing of the aligned openings in the lower leg portion. This arrangement of clamping the lower lumber length to the lower leg portion is less secure than the method of clamping the upper and intermediate lumber lengths, but this is not important as pressure from the poured concrete within the flexible form element 147 generates an upwards and outwards force on the lumber lengths and forces them against the lower leg portions, thus essentially eliminating movement therebetween.

Figure 12:
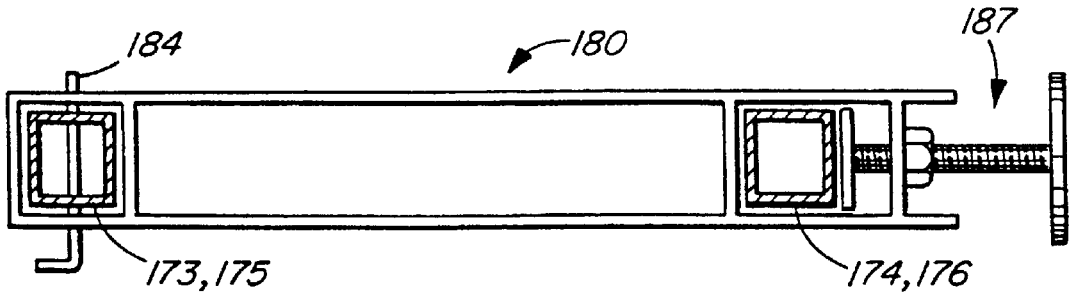
FIG. 12 is a simplified fragmented section on line 12—12 of FIG. 10 showing a second embodiment of a leg tie and associated portions of the form support, the leg tie being non-adjustable in length.
Figure 13:
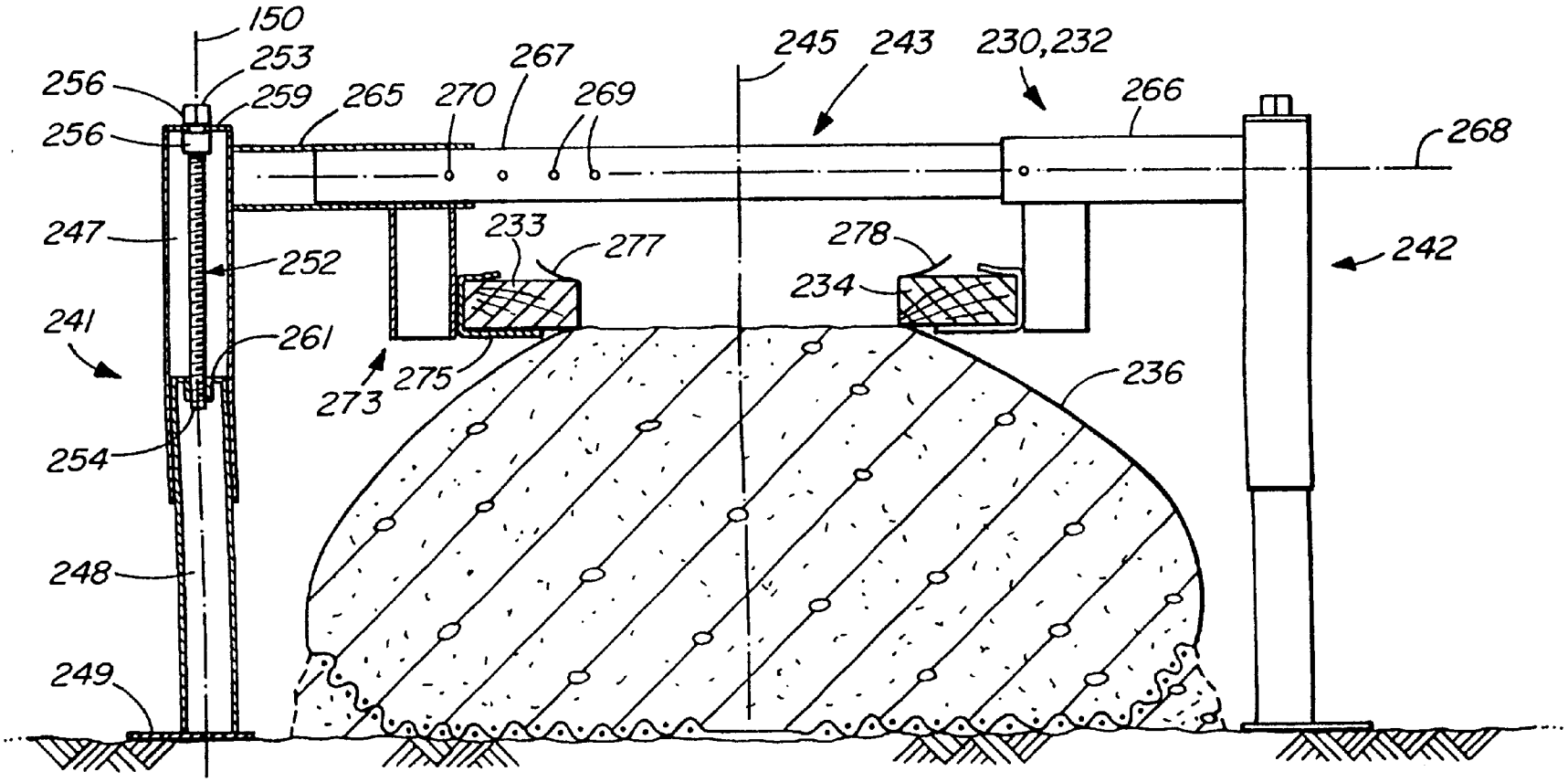
FIG. 13 is a simplified transverse section of a third embodiment of the apparatus according to the invention, showing a transverse form support with telescoping legs and producing a footing only, prior to stripping the form.

Referring to FIGS. 10 and 12, the fixed length leg tie 180 is shown engaging the upper portions 175 and 176 of the first and second legs 173 and 174 respectively. The dowel 184 passing through aligned openings in the first leg and leg tie 180 locates the first end portion of the leg tie 180. The tie clamp 187 at the second end portion of the leg tie engages the second leg 174 to permit fine adjustment in a manner similar to the connector clamp 70 of the form connector 46 of FIGS. 2 and 4. Thus, the first end portion of the leg tie is moveable incrementally with respect to the first leg by amounts dependent on spacing between the openings 185, whereas the tie clamp 187 permits infinitesimal adjustment of the second leg with respect to the leg tie. This adjustment ensures that the upper portions of the legs can be disposed generally vertically, irrespective of transverse or lateral sloping of the site surface as shown in FIG. 8. Clearly, if desired, a variable length leg tie, generally similar to the leg tie 48 of FIGS. 2–5 could be substituted for the fixed length leg tie as shown in FIGS. 9–10.

Operation of the second embodiment 145 of the building foundation form apparatus is generally similar to the first embodiment 12 of FIGS. 1–8 with main differences being as follows. Because the foundation form 145 produces a footing and wall as a combined unit, the flexible sheet form element 147 of FIGS. 9–12 is considerably wider than the sheet form element 25 of FIGS. 1–8. Thus the sheet form element 147 is provided with first and second sets of longitudinal guidelines, not shown, disposed closely adjacent and parallel to the first and second edge portions 148 and 149 of the flexible sheet form element 147. Because of the enlarged width of the sheet element 147, intermediate portions extending between the contact portion, not shown, and the edge portions are much wider than the intermediate portions 117 and 118 of the first embodiment 12.

FIG. 13

A third embodiment 230 of a building foundation form apparatus according to the invention includes an alternative transverse form support 232 which supports first and second longitudinal form supports 233 and 234 respectively, which in turn support a flexible sheet form element 236 in a manner similar to the first embodiment 12 of FIGS. 1–8. The third embodiment is generally equivalent to the first embodiment 12 as both embodiments produce a foundation footing with or without a relatively short wall.

The transverse form support 232 has first and second legs 241 and 242 and a leg tie 243 interconnecting the legs to maintain the legs generally parallel to each other. Similarly to the previously described transverse form supports, the form support 232 is generally symmetrical about a vertical plane of symmetry 245, and thus only one half of the form support will be described.

The first leg 241 has upper and lower leg portions 247 and 248 and a base plate 249 fitted to the portion 248 as shown The upper portion 247 is a tube which can telescope over the lower portion so that the leg portions are mounted for telescopic extension and retraction along a substantially vertical longitudinal axis 250 of the leg. The leg 241 includes a threaded shaft 252 having upper and lower ends 253 and 254 respectively. The upper end has a pair of stops 256, and an upper end of the upper leg portion 247 has a top plate 259 with an opening therein to receive the shaft. The stops 256 are located on opposite sides of the top plate to permit rotation of the shaft 252 relative to the plate while limiting axial movement of the shaft. The lower leg portion has a top plate 261 with a threaded opening therein to receive the shaft 252, so that rotation of the shaft causes axial extension or retraction of the upper leg portion with respect to the lower leg portion.

The leg tie 243 has first, second and third tie portions 265, 266 and 267, the first and second tie portions being similar to each other. The tie portion 265 has a tube permanently and rigidly secured to the upper leg portion 247 so as to extend perpendicularly therefrom as shown. The third tie portion 267 is a sliding fit within the first and second tie portions so as to be mounted for extension and retraction along a substantially horizontal longitudinal axis 268 of the leg tie. The third tie portion 267 has a plurality of openings 269 therein, and the first tie portion has a pair of aligned openings which receive a dowel 270 to permit adjustment of the relative positions of the first and third tie portions as previously described. Clearly, the third tie portion can similarly be adjusted with respect to the second tie portion 266 so as to vary spacing between the legs 241 and 242.

The first tie portion also has a L-shaped bracket 273 extending downwardly therefrom, the bracket having a form support receiver 275 to receive the first longitudinal form support 233 therein as previously described. The flexible sheet form element 236 has a first outer edge portion 277 which is stapled to the first longitudinal form support 233 as previously described so as to support the sheet form element as shown. The support 234 similarly supports an opposite second outer edge portion 278 to form the sheet form element 236 as before.

The third embodiment 230 is more costly to produce than the first embodiment 12 but has the added advantage that rotation of the threaded shaft 252 permits very accurate and easy vertical adjustment of the position of the longitudinal form support 233, when compared with adjustment of the longitudinal form connectors of the two previously described embodiments.

FIG. 14

A fourth embodiment 285 of a building foundation form apparatus according to the invention has many similarities to the third embodiment 230 of FIG. 11, but can be used to produce a footing and foundation wall from a single installation, and thus functions generally equivalently to the second embodiment 145 of FIGS. 9–12.

The fourth embodiment has first and second legs 291 and 292 and a leg tie 294 extending between the legs as shown. The transverse form support 288 is symmetrical about a vertical plane of symmetry 296, and some of the similarities to the third embodiment are as follows. The first leg 291 has telescoping upper and lower leg portions 301 and 302 which are moveable axially relative to each other by a threaded shaft 305 in a manner similar to the third embodiment. The leg tie 294 is more complex than the tie 243, and has a first tie portion 309 which has horizontally disposed inner and outer portions 311 and 312 which are interconnected by a vertical intermediate portion 314. The upper leg portion 301, and the portions 311, 312 and 314 are preferably square-sectioned tubing which is welded together to form a rigid structure in a general Z-shape as shown. The leg tie 294 has a second tie portion 318 which cooperates with the second leg 292, and a third tie portion 319 which is a sliding telescopic fit within the inner portion 311 and the second tie portion 318. The third tie portion is located with respect to the first and second tie portions by dowels 320 in a manner similar to the dowel 270 of FIG. 11.

A first form connector 322 has a slide portion 324 which is a tube mounted for a sliding movement vertically on the intermediate portion 314 and can be secured at a particular location by a dowel passing through aligned openings or by screw clamp means as previously described, none of which are shown. The form connector 322 has a form support receiver 325 which receives a first longitudinal form support 327 in a manner as previously described. The apparatus further includes a flexible sheet form element 329 which has a first edge 0 secured to the first longitudinal form support 327 by staples as previously described. Similarly to the second embodiment, additional form support receivers can be provided on the intermediate portion 314 of the first portion of the leg tie 309 to provide additional lateral support for a foundation wall extending further upwardly from the present position as shown.

FIGS. 15–17

An alternative lightweight foundation form embodiment 135 is for producing concrete ground beams for relatively light buildings such as commercial greenhouses.

Figure 15:
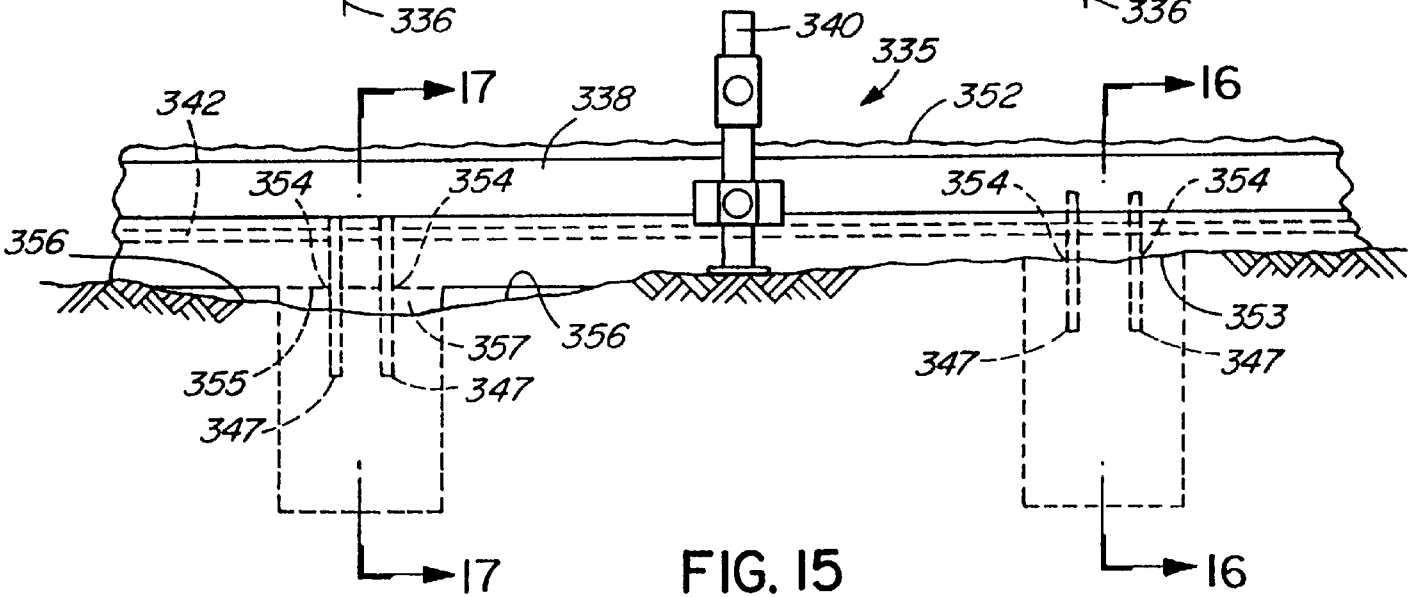
FIG. 15 is a simplified fragmented side elevation of a lightweight "ground beam" embodiment of a foundation form apparatus according to the invention, as used on lightweight buildings, eg. greenhouses and the like, FIG. 16 is a simplified fragmented section on line 16—16 of FIG. 15 showing cooperation between a portion of the ground beam foundation and a poured concrete pile foundation in which adjacent portions of the foundation form apparatus are fully supported by the ground.

The alternative embodiment 335 has first and second longitudinal form supports 337 and 338 supported by a plurality of transverse form supports 340, all of which are located symmetrically along a vertical foundation plane 336 as previously described. If necessary, one or more longitudinal reinforcing bars 342 extend along the foundation form. One transverse form support 340 only is shown in FIG. 15, and is shown simplified in broken outline in FIGS. 16 and 17. The site surface 10 is roughly levelled, and a plurality of "point" foundations are prepared by auguring circular holes into the site surface. The holes are usually about 1–2 feet (30–60 cm) deep or sufficient to sustain loads, about 12–18 inches (30–45 cm) in diameter, and spaced apart about 6–9 feet (2–3 metres) longitudinally along the foundation, depending on engineering requirements. Concrete is poured into these holes to provide a plurality of longitudinally spaced apart poured concrete piles 343 and 344 which have upper surfaces 345 and 346 respectively which are generally level with adjacent portions of the site surface 10. If the surface 10 has undulations as shown, the upper surfaces 345 and 346 are not within the same horizontal plane. If required, a plurality of vertical reinforcing bars 347 (broken outline) extend upwardly from the surfaces 345 and 346 and can be installed by being set in the concrete before it cures.

Figure 16:
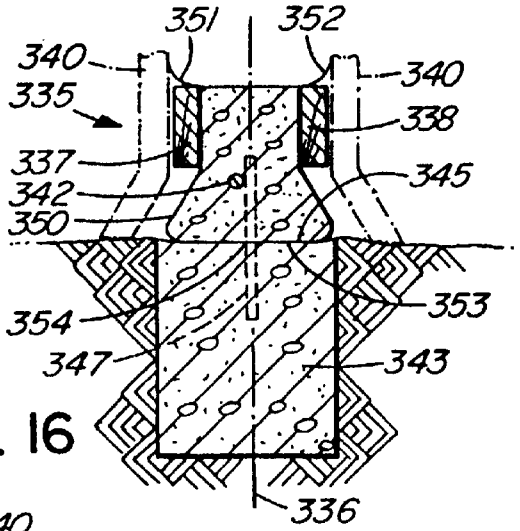
Figure 17:
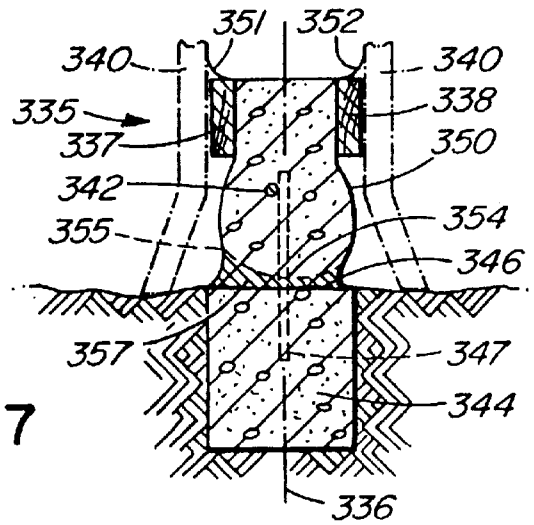
FIG. 17 is a simplified fragmented section on line 17—17 of FIG. 15 showing cooperation between a portion of the ground beam foundation and a poured concrete pile foundation in which adjacent portions of the foundation form apparatus are clear of the ground.

The transverse form supports 340 can be similar to those shown in FIG. 2, only smaller if necessary, and are located symmetrically with respect to the plane 336 which is also symmetrical with the poured concrete piles 343 and 344 as shown in FIGS. 16 and 17.

Figure 14:
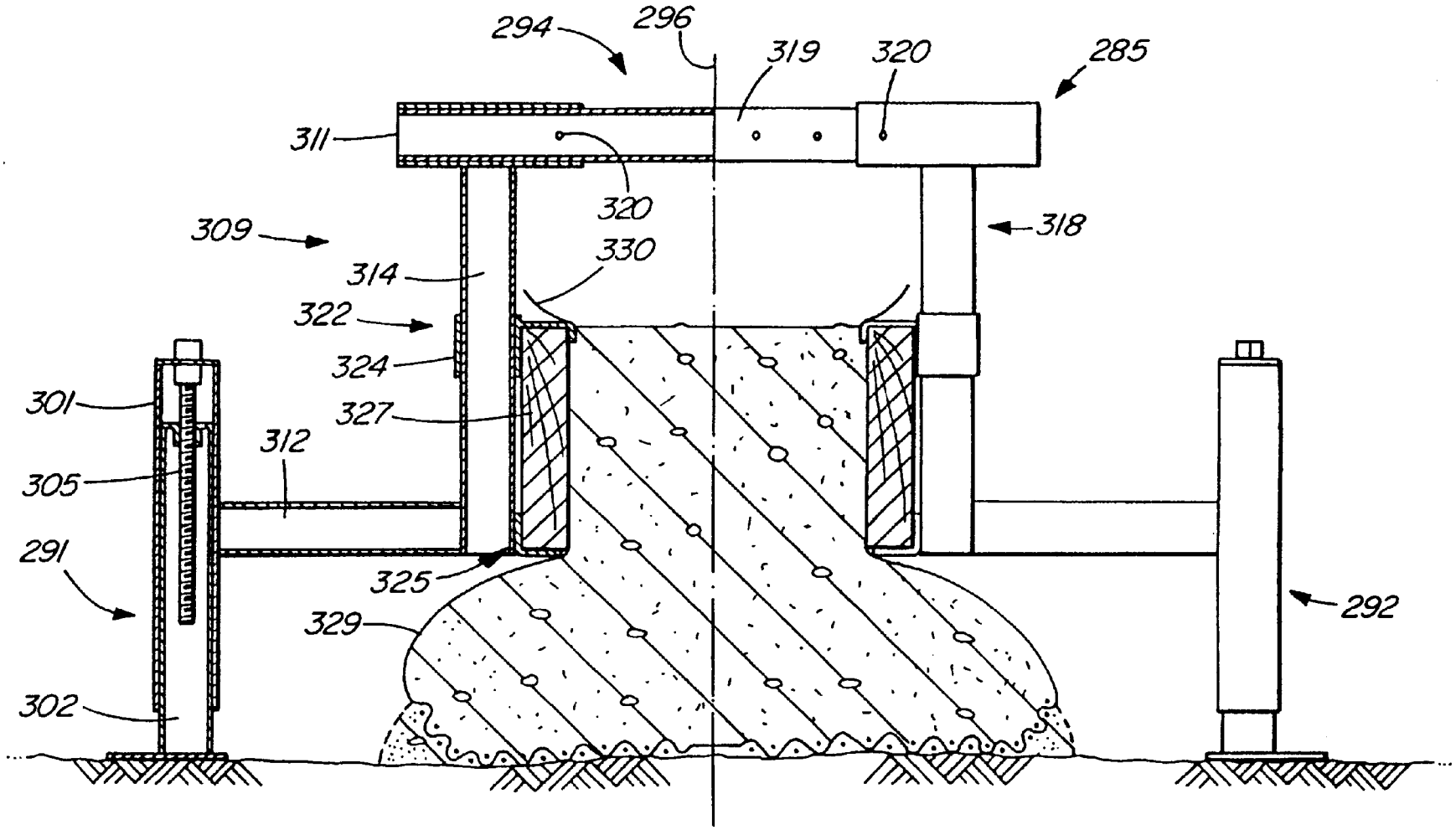
FIG. 14 is a simplified transverse section of a fourth embodiment of the foundation form apparatus according to the invention, the transverse form support having telescoping legs and providing a footing and short wall.

A flexible sheet form element 350 is positioned to lie along the axis of the foundation, ie. symmetrically of the plane 336. The sheet element can be of uniform water permeability to enhance consolidation and does not have specific longitudinally extending mesh portions equivalent to those found in the marginal portions 47 and 49 and the contact portion 60 of the embodiment 12. If the reinforcing bars 347 extend from the concrete piles, they can also be used to locate the sheet form element 350 symmetrically of the plane 336 of the foundation as follows. The reinforcing bars are punched through the centre line, not shown, of a contact portion 353 of the sheet form element 350 and can produce a corresponding opening 354 in the sheet form element to pass concrete aggregate therethrough around the bar to contact the upper surface of the piles. If no bars 347 are used, the opening 354 is cut in the contact portion 353 of the sheet element to pass aggregate therethrough. In any event, the opening 354 in the contact portion 353 functions generally equivalently to a small area of the mesh portion of the contact portion 60 of FIGS. 14 to increase adhesion of the beam to the pile. However, as there is no requirement to increase footing width in this embodiment, there is no requirement to produce laterally extending slumped concrete equivalent to that discharged from the marginal portions 47 and 49 of FIGS. 1–8. First and second edge portions 351 and 352 of the sheet element are stapled to the longitudinal form supports 337 and 338 respectively, using appropriate equivalent guidelines as previously described to ensure symmetrical location of the flexible sheet form with respect to the form supports.

Referring to FIG. 15, at the right hand portion of the form, the surface 345 of the pile 343 is higher than the surface 346 of the pile 344. As best seen in FIG. 16, the contact portion 353 of the flexible sheet form element 350 contacts the surface 345 of the pile. When concrete is poured into the support form element, concrete flows through the opening 354 in the sheet form produced by the reinforcing bar 347 (or separately cut) and will tend to bond to the upper surface 345 of the pile, thus ensuring adequate lateral restraint and support for the foundation form.

In contrast with the previous embodiments, the alternative embodiment 335 can accommodate excessive undulations which are sufficiently large as to result in short portions of the sheet form element being spaced above the site surface 10 as a simply supported beam. In other words, when the concrete of the foundation is cured, there can be clearances underneath the foundation form itself for relatively short suspended portions of foundation, provided the suspended portions of the foundation have adequate support provided by an adjacent poured concrete pile or site surface as will be described with respect to FIG. 17.

FIG. 17 shows a left hand portion of the flexible sheet form element 350 which has a lowermost base portion 355 spaced vertically above the upper surface 346 of the concrete pile 344, ie. the base portion initially is not directly in contact with the pile upper surface 346. As shown in FIG. 15, the base portion 355 is also spaced above adjacent depression portions 356 of the site surface 10. When concrete is poured into the left hand portion of the foundation form apparatus, concrete passes through the opening 354 produced by the reinforcing bar 347 and slumps downwardly and outwardly onto the surface 346 to produce a portion of slumped concrete 357 which effectively fills the space between the base portion 355 and the surface 346 of the concrete pile. As indicated earlier, the slumped concrete 357 provides a downwards connection to the pile surface, and thus is more equivalent to the concrete passing through mesh openings of the contact portion 60 of FIGS. 1–8, than to the slumped concrete 63 passing through the marginal portions 47 and 49. Thus, when the concrete foundation has cured, the space between the lowermost base portion 355 of the flexible sheet form element 350 and the concrete pile surface 346 has been bridged by the slumped concrete 357, thus providing direct support for the otherwise unsupported or suspended portions of concrete form which extend across the portions 356 of the undulation in the site surface 10. Thus the beam is supported adequately along its length.

It can be seen that in this embodiment, most of the contact portion of the flexible sheet form element 350 is still in contact with and supported by the site surface or by an adjacent pile surface. However, any suspended portions of the finished foundation that are not in direct contact with a pile surface or the site surface can be adequately supported by the slumped concrete 357 to serve as a foundation beam extending at least partially between point foundations or undulations of the site.

FIGS. 18–20

An alternative "point foundation" or foundation pier form 360 differs from the previous embodiments of the invention by providing a flexible sheet fabric form which is essentially self-supporting, and thus eliminates the need for both transverse and longitudinal form supports of the previous embodiments. Because the form is fabric and relatively low cost to produce, similarly to the previously described embodiments the form 360 is expendable because it can not be easily separated from the poured concrete foundation. Thus, in contrast with the previous embodiments there are no reusable aspects of this alternative, but as the sheet material is relatively low cost, this form is considerably less costly than any other forms known to the inventor. In addition, this embodiment is used in applications where perimeter foundations are not used and thus increases versatility of the invention.

In the prior art, point foundations or piers were prepared by placing pre-cast concrete blocks at appropriate positions on the site, by pouring concrete into fabricated wooden forms, or more recently, by pouring concrete into spiral wound, tubular cardboard molds, one type of such mold being sold under the name HANDIFORMS, a trademark of Perma Tubes Ltd. of Toronto, Canada.

Figure 18:
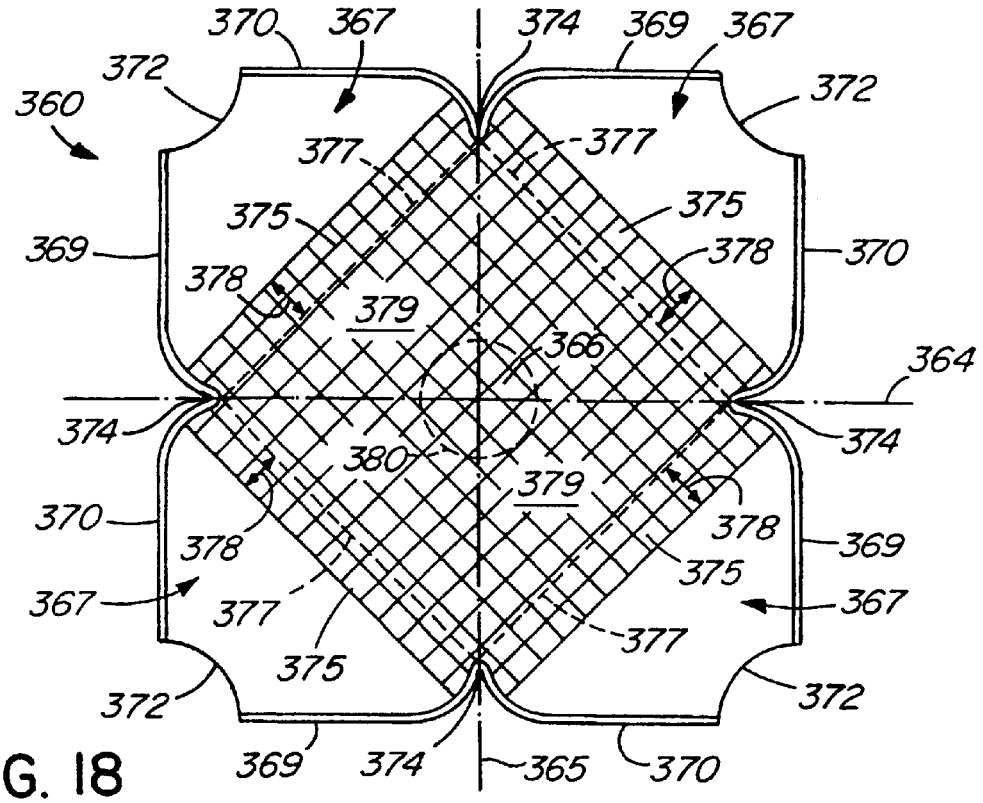
FIG. 18 is a flattened fabric pattern of an alternative point foundation form or foundation pier form according to the invention, prior to sewing the fabric.

The embodiment of the form 360 is made from a pattern of flexible fabric 361, shown flattened in FIG. 18. The fabric is preferably manufactured to provide mesh openings therein in a specific area to permit a controlled discharge of foundation material therethrough to provide the advantages found in the previous embodiments. A sheet of suitable fabric is cut according to the pattern of fabric 361, and in this instance has an overall generally square platform, although other shapes could be devised. Consequently, the pattern has two mutually perpendicular axes of symmetry 364 and 365 which intersect at centre 366 and divide the pattern into four equally shaped quadrants 367. Each quadrant has generally perpendicular side edges 369 and 370 which are intersected by a concave edge 372 which extends over an arc of 90 degrees as shown, all edges being disposed symmetrically with respect to the centre 366. Adjacent side edges of each quadrant intersect at cusps 374 disposed halfway along each edge of the square, and disposed symmetrically about the axes 364 and 365. The side edges 369 and 370, and the cusps 374 are provided with seam allowances for sewing together.

Figure 19:
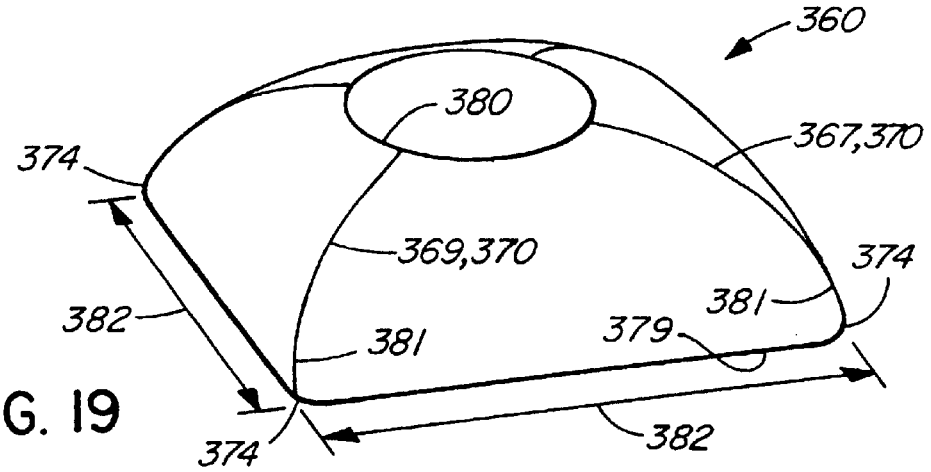
FIG. 19 is a simplified perspective of the fabric form of FIG. 18 shown after sewing and after being filled with concrete.

To produce the completed foundation form 360 shown in an extended position in FIG. 19, adjacent side edges 369 and 370 are sewn to respective adjacent side edges by bending each quadrant smoothly and approximately parallel to bend axes 377 shown in broken outline and extending from positions adjacent each cusp 374. It can be seen that the concave edges 372 cooperate to produce a generally circular opening 380 at an upper portion of the form, general location of which is also shown in broken outline in FIG. 18 and is generally concentric with the centre 366. The cusps 374 form curved corners adjacent ends of the bend axes 377 which define outer limits of the completed form. The bend axes 377 define a generally square base or contact portion 379 for the form 360 which is less than overall footing width 382. The form 360 has marginal portions 375 having a width 378 and extending peripherally around the contact portion 379. The contact and marginal portions have mesh portions to permit controlled discharge of foundation mixture therethrough as previously described. The marginal portions have equal length dimensions which define overall footing width 382, which is typically between 1 foot and 2 feet (30–60 cm), although larger and smaller forms can be made depending on engineering requirements.

Figure 20:
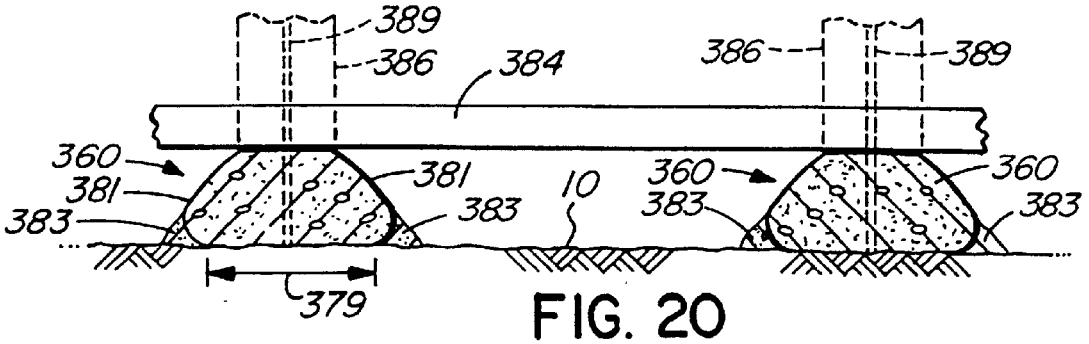
FIG. 20 is a simplified fragmented side elevation of two completed foundation footings made with the form of FIGS. 18 and 19, shown in two types of installations.

In operation, an operator temporarily manually holds an upper portion of the form to locate the opening 380 above the site surface to facilitate insertion of a pouring spout or equivalent into the opening during the initial phase of filling the form. When the opening is positioned above the site surface as shown in FIG. 19 to permit filling with concrete, inherent floatation and displacement of the concrete will stabilize the form so that it becomes self-supporting and assumes a generally symmetrical shape as shown in FIG. 19. As before, hydrostatic forces of the concrete within the form, and also shape of the pattern determines final shape of the form as shown in FIGS. 19 and 20. An overhanging bulge 381 similar to that found in the other embodiments will naturally form along each side of the form at the marginal portions 375 so that the contact portion 379 has a width which is initially smaller than the overall footing width 382.

Referring to FIG. 20, while the concrete is being poured into the form through the opening 380, a portion of the concrete within the form will eventually commence a controlled discharge of concrete through mesh openings in the marginal portions 375 to produce slumped concrete 383 from the overhanging bulges of the form extending peripherally around the form as shown. Similarly to previously described embodiments, the slumped concrete 383 increases "footprint" of the form from that which would otherwise be attained without the controlled discharge of foundation material. Clearly, as the contact portion 379 also has mesh portions, the portion 379 is also subject to a controlled discharge of foundation material which will tend to fill any voids between the contact portion and the site surface 10, thus improving shear resistance.

A series of footings can be provided around the perimeter of the building or other structure, and these can be used in the normal manner of prior art point foundations or pier footings. For example, a horizontal beam 384 can extend between adjacent footings to provide a support for a wall or other structure. Alternatively, tubular cardboard molds 386 (broken outline) such as the HANDIFORM (Trademark) described above, can be temporarily supported on top of the set concrete within the footing, and can then be filled with concrete to provide a pour concrete pillar of appropriate height. Steel reinforcing bars 389, shown in broken outline in FIG. 20, can be installed prior to pouring to meet engineering requirements. Clearly, there are many other applications of this type of footing, which is shown to have a square plan form but other forms can be devised.

What is claimed is:

1. A building foundation form apparatus comprising:

(a) at least first and second transverse form supports adapted to be supported directly on the ground and longitudinally spaced apart along a longitudinal foundation axis, (b) at least first and second longitudinal form supports adapted to be located on opposite sides of, and substantially parallel to, the foundation axis, each longitudinal form support being connectable to said at least two transverse form supports so that each longitudinal form support is locatable at a position above the ground, and (c) a flexible sheet form element having first and second longitudinally extending edge portions and a contact portion located between the edge portions, transverse spacing between the edge portions defining width of the sheet element when flattened the first and second edge portions being securable to the first and second longitudinal form supports respectively, so that the sheet form element is supportable partially by the longitudinal form supports and can lie substantially along the foundation axis, the width of the sheet form element being such that most of the contact portion thereof is at least partially supportable on the ground when the flexible sheet form element is deformed into a general U-shape and receives a flowable and settable foundation mixture.

2. An apparatus as claimed in claim 1, in which each transverse form support comprises:

(a) first and second legs supportable on the ground on opposite sides of the longitudinal foundation axis, each leg having upper and lower leg portions, each lower leg portion having a base portion to resist ground penetration and each upper leg portion having a form connector, and (b) a leg tie extending substantially transversely across the longitudinal axis and cooperating with the respective legs to connect the legs rigidly together.

3. An apparatus as claimed in claim 2, in which:

(a) the leg tie is adapted to extend between the upper portions of the legs and is adjustable substantially vertically along the legs.

4. An apparatus as claimed in claim 2, in which:

(a) the leg tie is disposed generally perpendicularly and rigidly to the upper portions of each leg.

5. An apparatus as claimed in claim 2, in which:

(a) the upper portion of each leg is generally straight and vertical, and (b) the lower portion of each leg is secured to and inclined at an angle to the respective upper portion of the leg, and extends downwardly from the upper leg portion and also outwardly away from the remaining leg.

6. An apparatus as claimed in claim 2, in which:

(a) the upper and lower leg portions are separable and are mounted for extension and retraction along a substantially vertical longitudinal axis of the respective leg, and (b) the leg tie has separable tie portions which are mounted for extension and retraction along a substantially horizontal axis thereof.

7. An apparatus as claimed in claim 1 in which:

(a) the flexible sheet form element has at least one controlled discharge portion which can pass therethrough a portion of the foundation mixture.

8. A building foundation comprising a foundation form apparatus and a set foundation mixture contained therein, the form apparatus comprising:

(a) at least first and second transverse form supports supported directly on the ground and longitudinally spaced apart along a longitudinal foundation axis, (b) at least first and second longitudinal form supports located on opposite sides of, and substantially parallel to, the foundation axis, each longitudinal form support being connected to said at least two transverse form supports so that each longitudinal form support is located at a position above the ground, and (c) a flexible sheet form element having first and second longitudinally extending edge portions and a contact portion located between the edge portions, the first and second edge portions being secured to the first and second longitudinal form supports respectively so that the sheet form element is deformed into a general U-shape to contain the mixture and is at least supported partially by the longitudinal form supports and lies substantially along the foundation axis, the sheet form element having a width such that most of the contact portion is at least partially supported on the ground.

9. A foundation as claimed in claim 8 in which:

(a) the flexible sheet form element has at least one controlled discharge portion which can pass therethrough a portion of the foundation mixture, and the foundation further comprises:

(b) a slumped portion of the foundation mixture which passed through the controlled discharge portion, the stumped portion extending between the ground and foundation mixture within the flexible sheet foundation element to increase width of the foundation in contact with the ground.

10. A foundation as claimed in claim 8, in which:

(a) each transverse form support comprises first and second legs supported on the ground on opposite sides of the foundation axis and a leg tie, each leg having upper and lower leg portions, each lower leg portion having a base portion to resist ground penetration, and each upper leg portion having a form connector, the leg tie extending substantially transversely across the longitudinal axis and cooperating with the respective legs to connect the legs rigidly together, and (b) the first and second longitudinal form supports co-operate with the form connectors located on the first and second legs respectively so as to locate the longitudinal form supports above the ground.

11. A foundation as claimed in claim 10, in which:

(a) each leg tie extends between the upper portions of the respective legs and is adjustable substantially vertically along the legs.

12. A foundation as claimed in claim 10, in which:

(a) each leg tie is disposed generally perpendicularly and rigidly to the upper portions of each leg.

13. A foundation as claimed in claim 10, in which:

(a) the upper portion of each leg is generally straight and vertical, and (b) the lower portion of each leg is secured to, and inclined at an angle to the respective upper portion of the leg, and extends downwardly from the upper leg portion and also outwardly away from the remaining leg.

14. A foundation as claimed in claim 10, in which:

(a) the upper and lower leg portions are separable and are mounted for extension and retraction along a substantially vertical longitudinal axis of the respective leg, and (b) the leg tie has separable tie portions which are mounted for extension and retraction along a substantially horizontal axis thereof.

15. A foundation as claimed in claim 10, further comprising:

(a) a leg restricter extending between lower leg portions of each transverse form support to restrict outward movement of the lower leg portions.

16. A foundation as claimed in claim 15 in which:

(a) the base portions have connectors and the leg restricter has opposite end portions adjacent each base portion, each end portion having a connector complementary to the connector of the base portion to be releasably connected thereto.

17. A transverse form support for use in a foundation form apparatus, the transverse form support comprising:

(a) first and second legs, each leg having upper and lower leg portions, each lower leg portion having a base portion to resist ground penetration, and each upper portion having a form connector, and (b) a leg tie extending generally permanently between the upper portions of the legs to connect the legs together, the leg tie being non-hingedly and perpendicularly connected to the upper portions of the legs to extend rigidly therebetween so as to maintain the upper portions of the legs generally parallel to each other.

18. A support as claimed in claim 17 in which:

(a) the leg tie extends between the upper portions of the legs and is adjustable substantially vertically along the legs.

19. A support as claimed in claim 17 in which:

(a) the leg tie has one end connected to the first leg by a dowel passing through an opening of the first leg, and an opposite end having a clamp for connecting to the second leg.

20. A support as claimed in claim 17 in which:

(a) the upper portion of each leg is generally straight and vertical, and (b) the lower portion of each leg is secured to and inclined at an angle to the respective upper portion of the leg, and extends downwardly from the upper leg portion and also outwardly away from the remaining leg.

21. A support as claimed in claim 17 in which:

(a) the upper and lower leg portions of each leg are separable and are mounted for relative extension and retraction, and (b) the leg tie has separable tie portions which are mounted for extension and retraction to vary spacing between the legs.

22. A support as claimed in claim 21 in which the tie portions of the leg tie comprise:

(a) a first tie portion secured rigidly to the upper leg portion of the first leg to extend generally perpendicularly therefrom, (b) a second tie portion secured rigidly to the upper leg portion of the second leg to extend generally perpendicularly therefrom, and (c) a third tie portion telescopically mounted with respect to at least one of the first and second tie portions to permit telescopic extension and retraction of the leg tie.

23. A support as claimed in claim 21 in which:

(a) the upper and lower leg portions of each leg are telescopically mounted for said extension and retraction along a substantially vertical longitudinal axis, and (b) the leg tie is telescopically extensible and retractable along a substantially horizontal axis thereof.

24. A support as claimed in claim 17 in which:

(a) the form connector comprises a form support receiver to receive a longitudinal form support, and a connector clamp secured to the receiver and being releasably clampable to the respective upper leg portion, the clamp being adjustable vertically along the upper leg portion.

25. A support as claimed in claim 24 in which:

(a) the form support receiver is located inwardly of the adjacent leg portion and within a vertical plane containing the tie member.

26. A method of installing a building foundation, the method comprising the steps of:

(a) supporting at least first and second transverse form supports directly on the ground and spaced apart along a longitudinal foundation axis, (b) locating at least first and second longitudinal form supports on opposite sides of the foundation axis, and connecting each longitudinal form support to said at least two transverse form supports so that at least one longitudinal form support is positioned above the ground on each side of the foundation axis and extends between the transverse form supports, (c) connecting first and second longitudinally extending edge portions of a flexible sheet form element to the first and second longitudinal form supports so that the sheet form element is deformed into a general U-shape and extends longitudinally between the first and second transverse form supports, and laterally between the first and second longitudinal form supports and is at least supported partially by the longitudinal form elements, and (d) pouring a flowable and settable foundation mixture into said at least partially supported flexible sheet form element so that most of a contact portion of the flexible sheet form element is at least partially supported on the ground when the flexible sheet form element deforms into the general U-shape due to weight of the flowable and settable foundation mixture.

27. A method as claimed in claim 26 further comprising:

(a) controlling discharge of a portion of the foundation mixture through a controlled discharge portion of the flexible sheet form element, the portion of mixture discharged contacting the ground to form a connection between the ground and foundation material contained within the flexible sheet form element.

28. A method as claimed in claim 27 further comprising:

(a) controlling discharge of a portion of the foundation mixture through the contact portion which comprises the controlled discharge portion so that the discharged mixture forms a connection between the ground beneath the contact portion and foundation mixture remaining within the form.

29. A method as claimed in claim 27 further comprising:

(a) controlling discharge of a portion of the foundation mixture through at least one marginal portion which comprises the controlled discharge portion, the marginal portion being located on at least one side of the contact portion and extending upwardly therefrom so that the discharged mixture fills a void that would otherwise be formed between the flexible sheet form element and the ground.

30. A method as claimed in claim 26 further comprising:

(a) supporting one leg of each form support on the ground on opposite sides of the foundation axis, (b) adjusting a leg tie of each form support to extend substantially transversely across the longitudinal foundation axis and to cooperate with the respective legs of the support to connect the respective legs rigidly together.

31. A method as claimed in claim 26, further comprising:

(a) adjusting the leg tie vertically with respect to at least one leg of a particular transverse form support generally to accommodate lateral variations in height of the ground, and (b) locking the leg tie with respect to at least one leg so as to locate the legs generally vertically and the leg tie generally horizontally.

32. A method as claimed in claim 26, further comprising:

(a) connecting the first and second longitudinal form supports to the respective transverse form supports so that at least upper surfaces of each longitudinal form support are within a generally horizontal plane.

33. A method as claimed in claim 26 further comprising:

(a) connecting together both legs of each form support with a leg restricter so as to restrict outwards movement of the legs.

34. A method as claimed in claim 33 further comprising:

(a) after the foundation mixture has set, disconnecting the first and second longitudinally extending edge portions of the flexible sheet element from the longitudinal form supports, (b) disconnecting the first and second longitudinal form supports from the transverse form supports to permit removal of the longitudinal form supports therefrom, (c) disconnecting ends of the leg restricters from the respective transverse form supports, and (d) removing the transverse form supports which leaves a set foundation mixture, the flexible sheet form element and the leg restricters remaining in place.

35. A method of installing a building foundation, the method comprising the steps of:

(a) supporting portions of a flexible sheet form element above the ground, the sheet form element being deformed to produce a foundation form and having a contact portion to contact the ground, (b) pouring a flowable and settable foundation mixture into the flexible sheet form element to be mostly contained within the foundation form, and (c) permitting controlled discharge of a portion of the foundation mixture from inside the form element through a controlled discharge portion thereof onto the ground to produce a connection therewith.

36. A method as claimed in claim 35, further comprising:

(a) permitting the sheet form element to deform to produce at least one bulge overhanging the ground adjacent an edge of the contact portion to define a void adjacent the edge of the contact portion and between the bulge and the ground, and (b) permitting controlled discharge of a portion of the foundation mixture within the form through a controlled discharge portion of the flexible sheet form element located adjacent and below the bulge to reduce size of said void while maintaining the contact portion in contact with the ground.

37. A method as claimed in claim 35 further characterized by:

(a) providing the controlled discharge portion with a mesh portion having a plurality of mesh openings which are larger than maximum size of aggregate within the foundation mixture.

38. A method as claimed in claim 35 further characterized by:

(a) locating the controlled discharge portion in a marginal portion extending outwardly and upwardly from the contact portion so that the marginal portion deforms into said at least one bulge to discharge material from the bulge onto the ground to reduce size of said void.

39. A method as claimed in claim 35 further characterized by:

(a) locating the controlled discharge portion in the contact portion so that foundation material passing through the controlled discharge portion can pass into any voids between the ground and the contact portion to enhance adhesion of the foundation to the ground while maintaining the contact portion in contact with the ground.

* * * * *